United States Patent [19]

De Boo et al.

[11] 3,973,661

[45] Aug. 10, 1976

[54] WIRE-MATRIX PRINTERS, AND ELECTROMAGNETIC ACTUATOR MECHANISMS USEFUL IN SUCH PRINTERS

[75] Inventors: Jerome L. De Boo, Barrington; Edmund C. Feldy, Evanston; Horace Stanley Grear, Mount Prospect, all of Ill.

[73] Assignee: Teletype Corporation, Skokie, Ill.

[22] Filed: May 8, 1974

[21] Appl. No.: 468,046

[52] U.S. Cl. ..... 197/1 R; 101/93.05; 101/93.33; 335/296

[51] Int. Cl.[2] ..... B41J 3/12

[58] Field of Search ..... 197/1 R; 101/93.04, 101/93.05, 93.11, 93.15, 93.29, 93.32, 93.33, 93.34; 234/109; 335/209, 261, 296

[56] References Cited

UNITED STATES PATENTS

| | | | |
|---|---|---|---|
| 2,869,455 | 1/1959 | Knutsen | 197/1 R X |
| 3,056,546 | 10/1962 | Zenner | 234/109 |
| 3,217,640 | 11/1965 | Bradshaw | 197/1 R X |
| 3,301,177 | 1/1967 | Shepard | 101/93.33 |
| 3,359,921 | 12/1967 | Arnold et al. | 101/93.15 |
| 3,672,482 | 6/1972 | Brumbaugh et al. | 197/1 R |
| 3,828,908 | 8/1974 | Schneider | 197/1 R |
| 3,842,955 | 10/1974 | Iwasaki | 197/1 R |

*Primary Examiner*—Ralph T. Rader
*Attorney, Agent, or Firm*—J. D. Kaufmann; J. L. Landis

[57] ABSTRACT

A wire-matrix printer including a vertical column of essentially horizontal, generally parallel print wires arranged for substantially linear reciprocation along spaced, parallel printing axes. The print wires are of progressively varying length so that the lowermost wire in the column is the shortest and each successive higher wire is a predetermined amount longer than the preceding wire. Thus, the outer or actuator ends of the wires define a horizontally spaced and vertically stepped array. An array of horizontally spaced and vertically stepped electromagnetic actuators is provided, as is means for flexibly coupling each print wire to an armature portion of the actuator.

Each electromagnetic actuator includes a flat, generally T-shaped armature, preferably a spring reed, and a flat, generally C-shaped magnet core. The core and reed are mounted generally parallel to each other, with the crossarm of the T facing and overlapping pole face portions defined at the inner tips of the arms of the C. The core is magnetized and demagnetized to attract and release the armature, thus reciprocating a workpiece such as a print wire coupled to the free end of the reed or armature.

Further details of significance relate to the positioning and geometry of the spring-reed-and-magnet t-core actuator assembly, particularly to the pole-face geometry and operational magnetic characteristics whereby the core acts as an electromagnet when attracting the reed and as a permanent magnet when latching it in a flexed cocked position, and to the electromagnetic operating principles; to a special flexible coupling for mounting workpieces such as the print wires to the flexing spring reed; and to a special mounting assembly for an array of such actuating assemblies such as in a print head of a matrix printer.

128 Claims, 17 Drawing Figures

51
12
Z
60
65
Y
66
10
87
71
72
80
85
73
74
80
75
87
62
27
76
85
77
152
151
70
69
21
68
50
83
67
134
R
132
136
131
130
143
131
130
142
137
163
135
123
82
81
141
124
164
81
146
146
162
161
160
160
43
122A
121
88-1
88-2
88-3
88-4
121
88-5
122A
88-6
88-7
122
106
41
42
11
43

FIG. 5
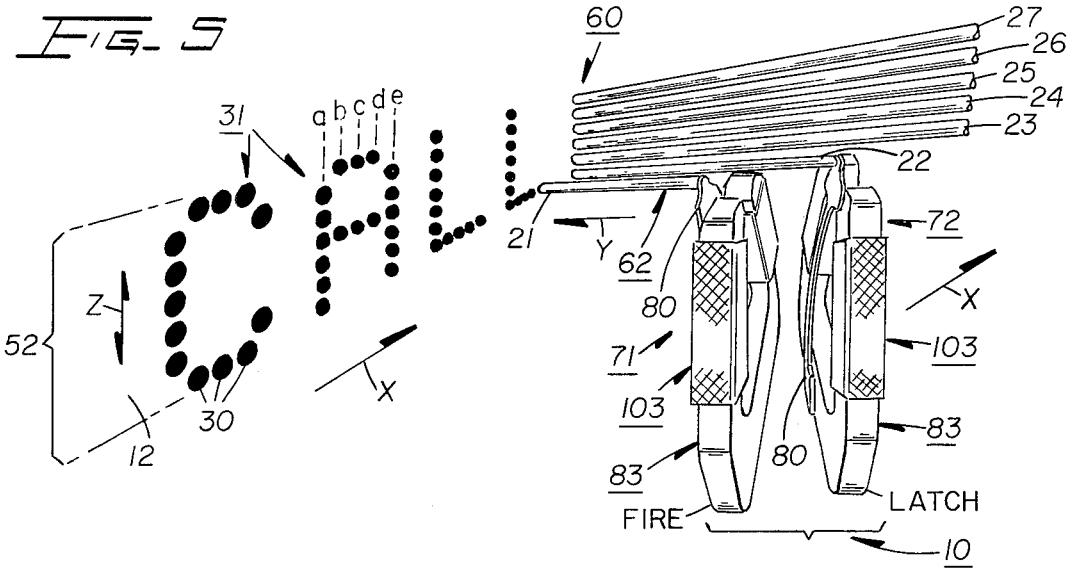
FIG. 6
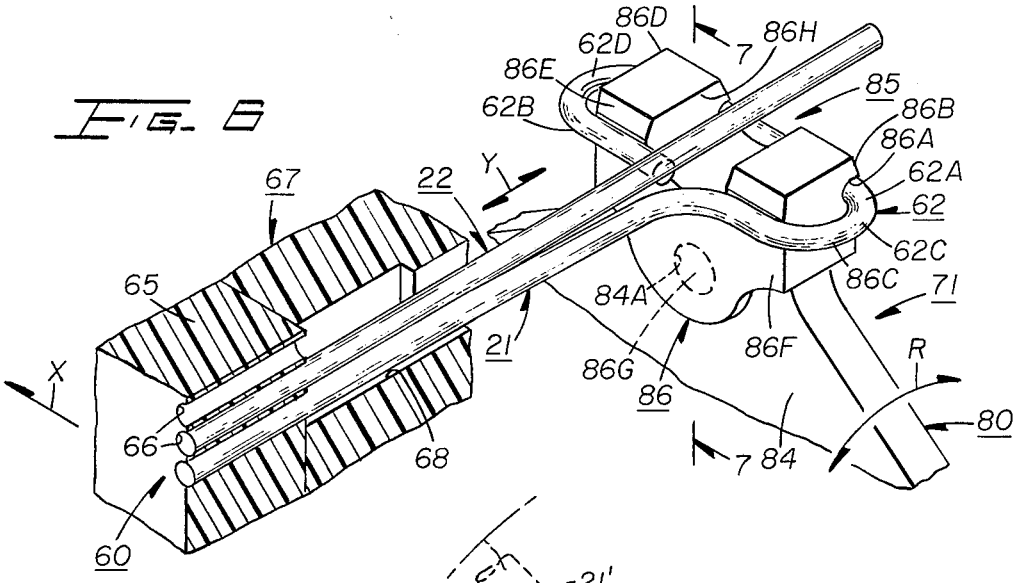
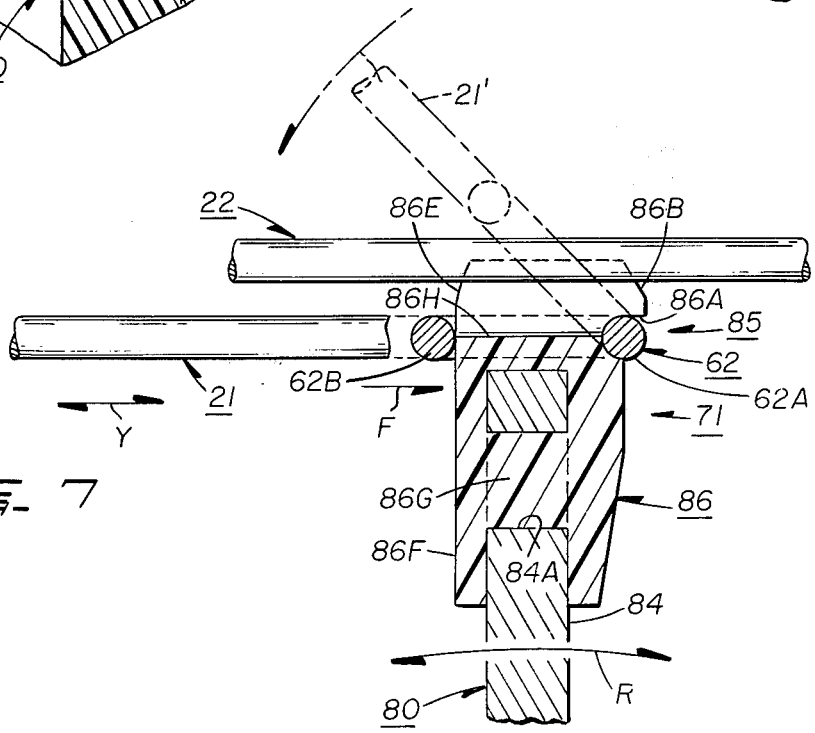
FIG. 7

S
φ
91
84
11
11
94
93
90
83
80
80S 90
91
D
92
D
91
90
80
94
93
83 d
S
φ
θ
77
91
A
D
C
83
90
80F
82
97
θ
85
62
27
86
84
93
94
R
80
80S
96
81
80B 105
80L
90
83
77
93
91
A
B
10
85
84
10
9
80
80S
80F
96
97
9
82
80W
86H
27
62
86
D
C
92
A
91
93
B
80B
81
90
105

WIRE-MATRIX PRINTERS, AND ELECTROMAGNETIC ACTUATOR MECHANISMS USEFUL IN SUCH PRINTERS

INTRODUCTION AND BACKGROUND

This application relates generally to wire matrix printers, and more particularly to a compact, rapid and economical arrangement of print wires and electromagnetic actuating mechanisms for a matrix printer. The application also relates to certain features of electromagnetic actuator mechanisms, generally, having particular utility in the selective operation of print wires such as are used in matrix printers.

Matrix printers of many styles have been known in the art for a great many years. Typical, generally related printers are disclosed in P. A. Brumbaugh et al. U.S. Pat. No. 3,672,482; A. S. Chou et al. U.S. Pat. No. 3,592,311; E. D. Finnegan U.S. Pat. No. 3,627,096; R. S. Bradshaw U.S. Pat. No. 3,217,640; W. Wockenfuss et al. U.S. Pat. No. 2,683,410; and K. A. Knutsen U.S. Pat. No. 2,869,455; all herein incorporated by reference. In various ones of such printers, a vertical column of spaced print wires is mounted on a carriage and traversed across a paper. In a typical example, using a 5 × 7 dot matrix for the characters, a column of seven print wires travels across the paper five steps or printing columns to the complete character. At each possible printing column, selected ones of the seven print wires (from zero to all seven) are actuated or "fired" to drive the printing ends of the selected wires against an inked ribbon and paper in a printing pattern, based on which wires were actuated; or the selected wires otherwise mark the record medium in any known fashion.

This invention, generally, seeks to improve such matrix printers by providing a very light, compact and inexpensive print head and print wire layout, particularly one with essentially straight, parallel print wires, and by providing a very small, efficient and extremely rapid electromagnetic actuating structure for operating such print wires. The invention also is concerned with new and improved electromagnetic actuator mechanisms having generally utility, and especially useful in selectively actuating an array of closely spaced, essentially parallel workpieces, such as the print wires of a matrix printer.

The invention is also concerned with improved electromagnetic actuator structures of the general class disclosed in W. J. Zenner U.S. Pat. No. 3,056,546, herein incorporated by reference. The Zenner patent relates to a punch system including a combination of a spring reed and an electromagnet for operating the reed to selectively cock and fire the reed and associated punch element. The present invention relates to improved actuators of the Zenner type that are small and compact, and low in electrical power consumption. The invention further concerns pole face and armature construction, geometry, and circuit operating principles for such electromagnetic actuators, particularly using a thin flat assembly of magnet cores and armatures. Further, the invention relates to improved flexible couplings for mounting a workpiece, such as a print wire, to a spring-reed actuator such as is disclosed in the Zenner patent.

SUMMARY OF THE INVENTION

With the foregoing and other objects in view, a wire-matrix printer in accordance with certain features of the invention includes a plurality of substantially straight print wires of uniformly varying length. The print wires, seven in a typical example, are mounted essentially horizontally and parallel to each other in a vertical column for substantially linear reciprocation along spaced parallel, essentially horizontal printing axes. The print wires are arranged in an array in which the lowermost wire in the column is the shortest and each successive higher wire in the column is a predetermined amount longer than the preceding one.

Preferably, the print wires are mounted and actuated by spring reeds mounted in a parallel row with one end fixed and the other end free to flex about the fixed end. The free ends of the reeds are positioned in alignment with the outer ends of the print wires, and means are provided for flexibly coupling the outer ends of the print wires to the free ends of the companion reeds so that the print wires reciprocate linearly upon flexing of the reeds.

In accordance with certain features of the invention, a mechanism for coupling a reciprocable wire to a spring reed actuator includes a plastic insert, preferably a molded plastic tip, mounted on the free end of the reed and a wire loop formed at the outer end of the wire and flexibly coupled about the plastic insert so that the wire moves essentially linearly along a work axis in response to flexing of the reed. Preferably, the wire loop comprises an expansion spring resiliently coupled, with a snap-on fit, to a plastic tip molded on the reed.

In accordance with other features of the invention, an actuator for moving a workpiece toward and away from a work station includes a *t*-shaped spring reed fixed at its base and with its tip free to flex toward and away from the work station. The workpiece, such as a print wire in the specific example, is mounted to the tip of the reed for movement toward and away from the work station upon flexing movement of the reed. The crossarm of the reed is biased away from the work station to hold the reed in a cocked position, preferably by magnetic attraction wherein the reed comprises a magnet armature. When it is desired to actuate the workpiece, the biasing force is released or reduced to the point where it can no longer hold the cocked reed, after which the cocked spring body fires the reed to drive the workpiece toward the work station. Various features of construction, mounting and geometry of the reed are of significance in preferred forms of the actuator mechanism to obtain a compact, powerful, and rapid-actuating actuator mechanism.

In accordance with additional features of the invention, an electromagnetic actuator in accordance with the invention includes a magnet core comprising a generally flat plate having a base portion and a pair of arms extending toward each other from the base portion so as to define an air gap in the space between the inner tips of the arms. Areas of the arms adjacent to the inner tips constitute spaced pole faces of the core. The core is mounted with respect to a companion armature and a work station so that portions of the armature are movable toward and away from the core and the work station along a line Y. The core is mounted generally perpendicular to the line Y, on the opposite side of the armature from the work station, and so that inner, generally flat surfaces of the core face the armature and work station. The pole faces are aligned with portions of the armature, and are disposed at spaced areas along the inner surface of the core. Means are provided for selectively magnetizing and demagnetizing the core so that (1) when the core is magnetized, it attracts the armature against the pole faces to bias the armature to a retracted position, away from the work station, and (2) when the core is demagnetized, the armature is magnetically released. When the core is demagnetized, the armature is driven toward the work station, preferably powered by a spring such as in the spring-reed armature construction summarized above.

Other details of significance relate to the shape, geometry and mounting arrangement of the pole faces with respect to a *t*-shaped, flat spring reed armature, and to magnetic latching and firing principles using a special core material that acts as an electromagnet when attracting the armature to the reed and as a permanent magnet when latched, which combinations are described hereafter in the specification in detail.

Another feature of the invention relates to an assembly of electromagnetic actuators, for independently moving selected ones of a plurality of associated workpieces toward and away from a work station. The assembly includes a plurality of flat, springreed magnet armatures corresponding one to each workpiece. The reeds are mounted in a parallel row so that one end of each reed is fixed and the other end thereof is free to flex toward and away from the work station and portions of the reeds are coupled to portions of the corresponding workpieces. A plurality of magnet cores are provided corresponding one to each reed. Each core comprises a flat plate having a pair of core arms extending toward each other from a base portion so as to define an air gap between the inner tips of the arms, areas of the arms adjacent to the inner tips constituting spaced pole faces of the core. The cores are mounted generally parallel to the companion reeds on the opposite side from the associated workpiece, so that the pole faces are aligned with facing portions of the corresponding reeds. The cores are selectively magnetized and demagnetized so that (1) when the core is magnetized, it attracts the facing portions of the reed against the pole faces to cock the reed in a retracted position with respect to the work station, and (2) when the core is demagnetized, the reed is magnetically released so that the cocked spring reed drives the associated workpiece forward toward the work station.

In accordance with further aspects of the invention, an electromagnet actuator includes a flat, generally C-shaped magnet core, and a flat, generally T-shaped armature of ferromagnetic material. The armature is mounted with respect to the core so that the core and armature are generally parallel to each other, and the crossarm of the T faces and extends across the space between the arms of the C. Areas at the tips of the crossarm overlap areas at the tips of the arms of the C, which latter areas define pole faces of the magnet core. The crossarm is movable toward and away from the pole faces of the core, and is normally spaced a predetermined distance from the pole faces when the core is in a neutral, nonmagnetized state. The spacing is set so that, when the core is magnetized, the crossarm is attracted to the pole faces. Further, means are provided for magnetizing and demagnetizing the core to attract and release the armature.

Other objects, advantages and features of the invention will appear from the following detailed description of a specific embodiment of the invention, when read in conjunction with the accompanying drawings.

DRAWINGS

FIG. 5 is a schematic, fragmentary perspective view, not drawn to scale, illustrating some of the basic principles of the printing process and typical matrix characters printed in accordance with the invention.

FIG. 6 is an enlarged, fragmentary perspective view similar to a portion of FIG. 2, showing a flexible coupling between one of the print wires and an armature reed of the actuating mechanism.

FIG. 7 is an enlarged vertical section through the coupling, along line 7—7 of FIG. 6.

DETAILED DESCRIPTION

General Arrangement of Printer

Figure 1:
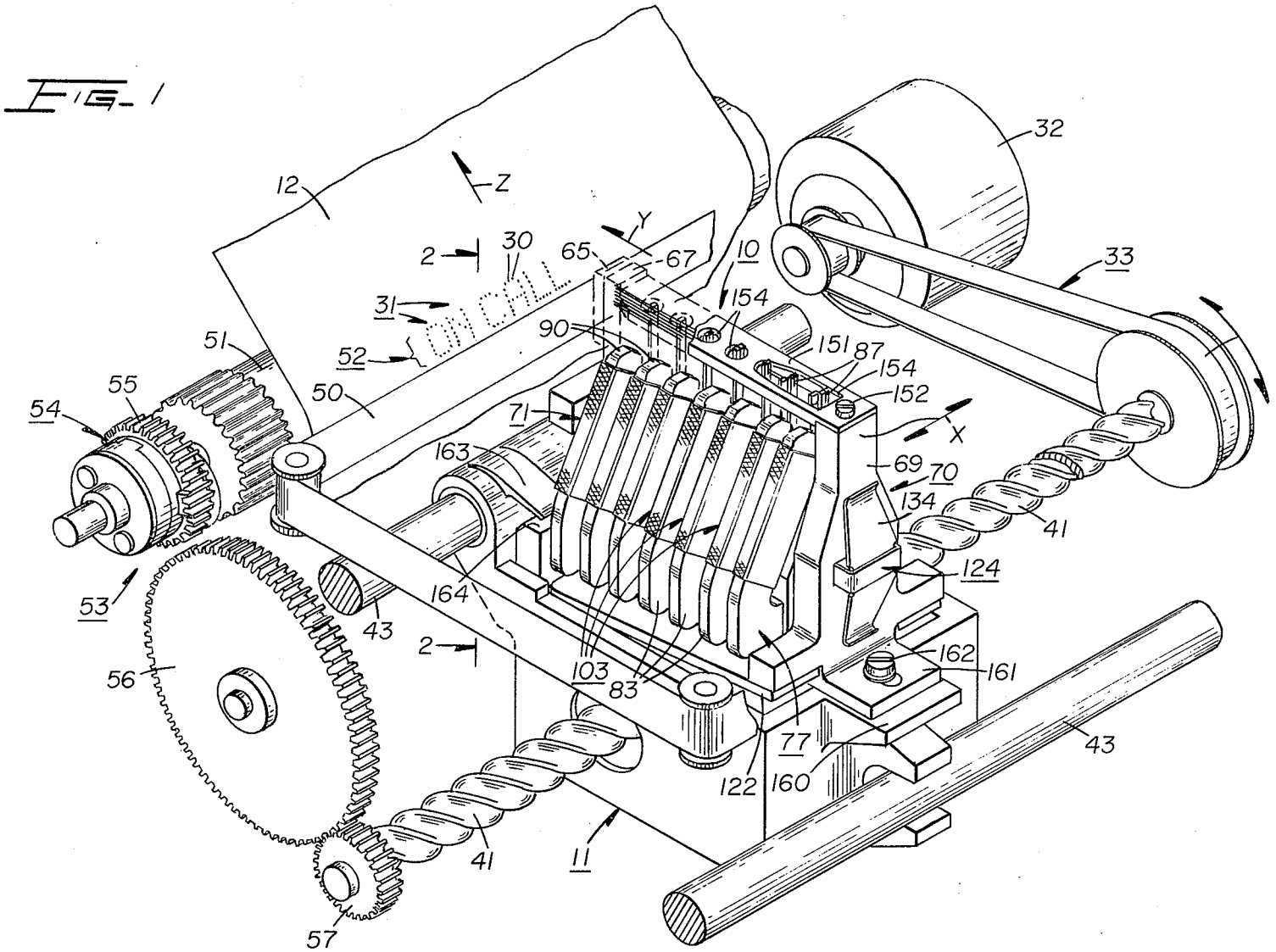
FIG. 1 is a front perspective view of a portion of a teleprinter in accordance with the invention, looking from the operator's side of the printer toward the paper.

Referring first to FIGS. 1 through 5, a wire-matrix printer is illustrated, including a print head 10 in accordance with a preferred embodiment of this invention. The head 10 is mounted on a generally conventional carriage 11 for linear traversing movement in a horizontal direction (X) across a paper 12 or other record medium on which printing is to take place. In the example, the print head 10 travels from the operator's left to right, as viewed in FIG. 1 or 5, during a forward or printing stroke, as with a conventional typewriter, and then returns to the left after each line has been printed.

The print head 10 includes a vertical column of print wires 21–27, seven in the example illustrated using a conventional 5 × 7 dot matrix for the characters. The print wires 21–27 are equally spaced vertically, to print successive vertical columns a-e (FIG. 5) of dots 30 on the paper 12, as required to form selected characters or other information patterns on the paper 12. As is conventional in the matrix-printing art, the print wires 21–27 are selectively actuated as the head 10 travels across the paper 12 to form matrix characters 31. With a head 10 having a single column of seven print wires 21–27, the carriage travel provides the X dimension of the conventional 5 × 7 dot matrix, as is well known, and the print-wire spacing provides the vertical or Z dimension of the characters. If lower-case letters are to be printed, or other more complex characters or patterns, then a 7 × 9 or even larger matrix is used, in this example by adding two or more additional print wires above and parallel to the top wire 27 shown in FIG. 5.

The carriage 11 is driven across the paper in the X or printing direction by a reversible, constant-speed drive motor 32 (FIG. 1), which in this embodiment turns a belt-and-pulley transmission 33 to rotate a conventional helical lead screw 41 on which the carriage 11 is threadedly mounted by a carriage nut 42 (FIG. 4), which may be conventional. Preferably, the nut 42 is formed as described in a commonly assigned patent application of Arthur F. Lindberg, Ser. No. 468,047, filed on the same date as this application, herein incorporated by reference. Alternatively, the carriage 11 can be driven step-by-step across the paper 12, with the print head stopping at each possible printing column *a–e* across the paper 12. The carriage 11 is mounted for linear reciprocation in the X direction along a pair of guide rods 43 (FIGS. 1 and 4), and is reciprocated by the motor 32 between start-of-line and end-of-line positions in generally conventional fashion.

Figure 4:
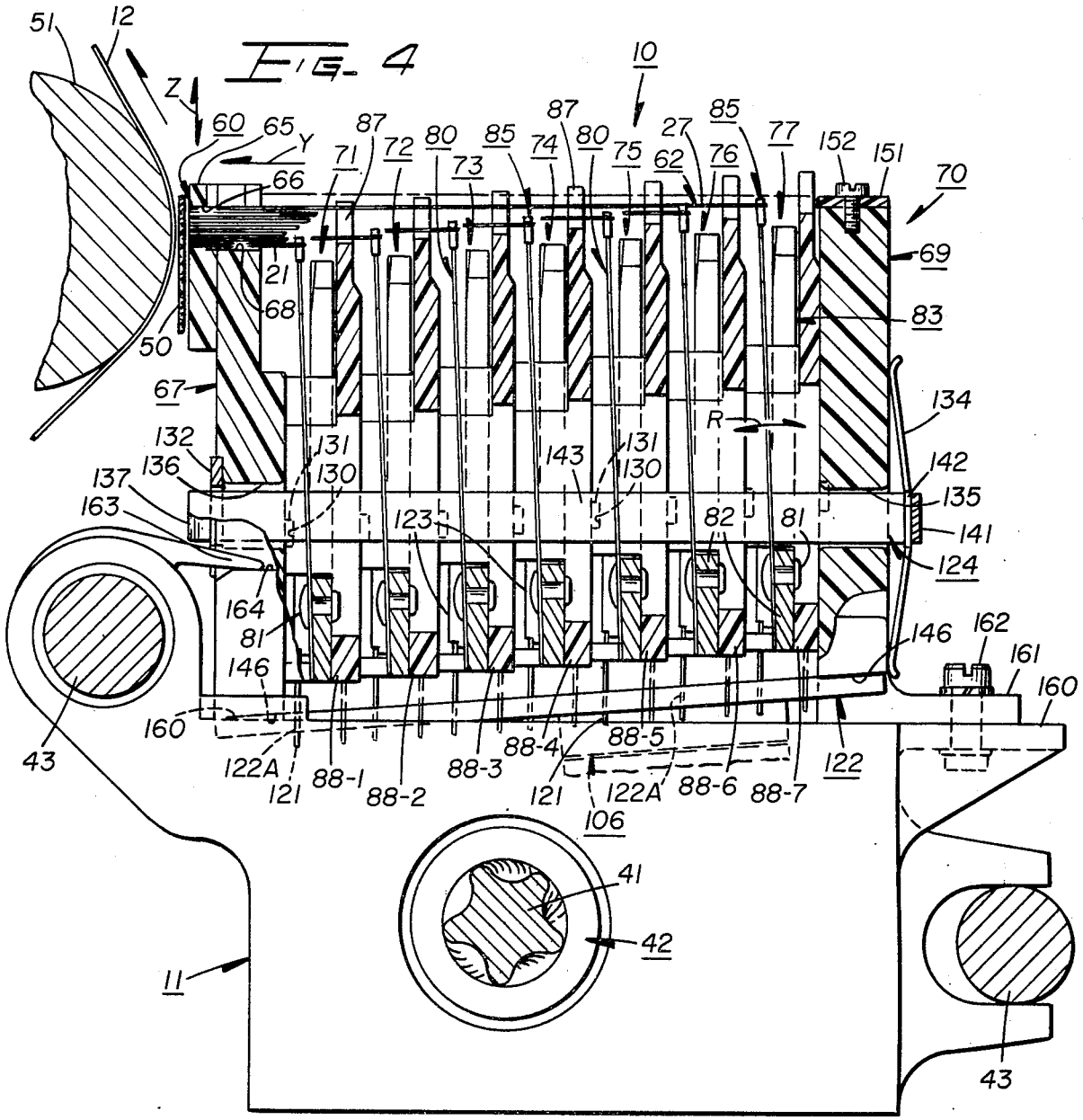
FIG. 4 is a central vertical section along line 4—4 of FIG. 3, illustrating the mounting and assembly of the print wires and actuating mechanism with respect to the paper.

As the print head 10 travels across the paper 12 in the X or printing direction, past each possible column-printing position such as *a–e* in FIG. 5, selected ones of the print wires 21–27 are actuated, on the fly, to print a column of from zero to seven vertical dots 30, as is required for the character being printed. As best depicted in FIGS. 4 and 5, the "actuated" wires 21–27 (those selected for printing) are driven a short distance in a horizontal direction Y (perpendicular to X), to impact against a type ribbon 50 (FIGS. 1 and 4), and to drive the ribbon 50 and adjacent portions of the paper 12 against a backing member of platen 51, in well-known fashion.

When a desired length of a line 52 of characters 31 has been printed, the carriage 11 is returned to the start or home position at the left in FIG. 1, and the paper 12 is stepped upward one or more character lines 52 in the Z direction, as in conventional typewriters. Preferably, this is done automatically by a line-feed mechanism 53, in preparation for printing of the following line. While any known line-feed mechanism may be used in accordance with this invention, a preferred line-feed mechanism 53 is described in the commonly assigned copending application of Ingard B. Hodne, Ser. No. 565,928, filed on Apr. 7, 1975, a continuation of Ser. No. 468,048, filed on the same date as this application but now abandoned, and herein incorporated by reference. In general, the line-feed mechanism includes a coupling or clutch 54, which is responsive to a line-feed signal and which positions a platen gear 55 in mesh with a speed-reduction gear 56 for a preset time interval during carriage return. The gear 56, in turn, is driven by a drive gear 57 mounted on the shaft of the lead screw 41, as shown.

Various other arrangements of print head 10 and paper 12 movement can be utilized. For example, in printing lines of text, one can step the platen 51 a desired number of lines at the end of the forward (left-to-right) stroke, and print the next row of characters on the return (right-to-left) stroke. To print graphs or other patterns possible with a matrix array of dots 30, generally referred to as "plotting," the platen 51 can be "rolled" (moved up and down) independently of carriage movement by incoming data signals, to provide a variable dimension to the plot, or the carriage may be independently movable by a slide-on-slide arrangement, such as by using a linear electric motor of the type shown in A. G. Wallskog U.S. Pat. No. 3,696,204 or G. Cless U.S. Pat. No. 3,688,035. Other details of the carriage system and the general printing mechanisms and operating circuits are not critical to the present invention, and may for example be arranged as described in the Brumbaugh et al. and other matrix printer patents previously cited.

In the commonly assigned copending application of Richard E. LaSpesa, Ser. No. 468,049, filed on the same date as this application and herein incorporated by reference, there is disclosed an optical system for generating timing pulses to synchronize printer operation in response to an encoder or code wheel mounted on the shaft of the stepping motor 32, and a mechanism for precisely setting the angular position of the sensor with respect to the code wheel.

Print Head 10 - General Arrangement of Print Wires 21–27

Referring now to FIGS. 2—5, showing a preferred layout of print wires 21–27 in accordance with the principles of this invention, the straight print wires 21–27 are arranged essentially horizontally in a spaced vertical column as shown, and are virtually parallel throughout their lengths. The inner or printing ends 60 of the wires 21–27 are mounted in a common vertical plane closely spaced from the platen 51, for example 0.01 to 0.06 inch when the wires are in cocked or non-printing positions, as will be described. A typical preferred spacing within this range is 0.035 inch.

In a preferred embodiment, the wires 21–27 are fabricated of music wire, approximately 0.013 inch in diameter; thus, they are relatively stiff and can readily be reciprocated short distances in the Y direction to print characters, without significant distortion or bending. Of course, the diameter and the vertical spacing (for example, 0.016 inch center-to-center) of the wires are dictated by the dot size and vertical spacing desired in the printed characters (FIG. 5). In the specific operating embodiment, adjacent print wires are vertically spaced by approximately 0.003 inch at the printing ends, as viwed in FIGS. 4, 5 and 6.

Figure 2:
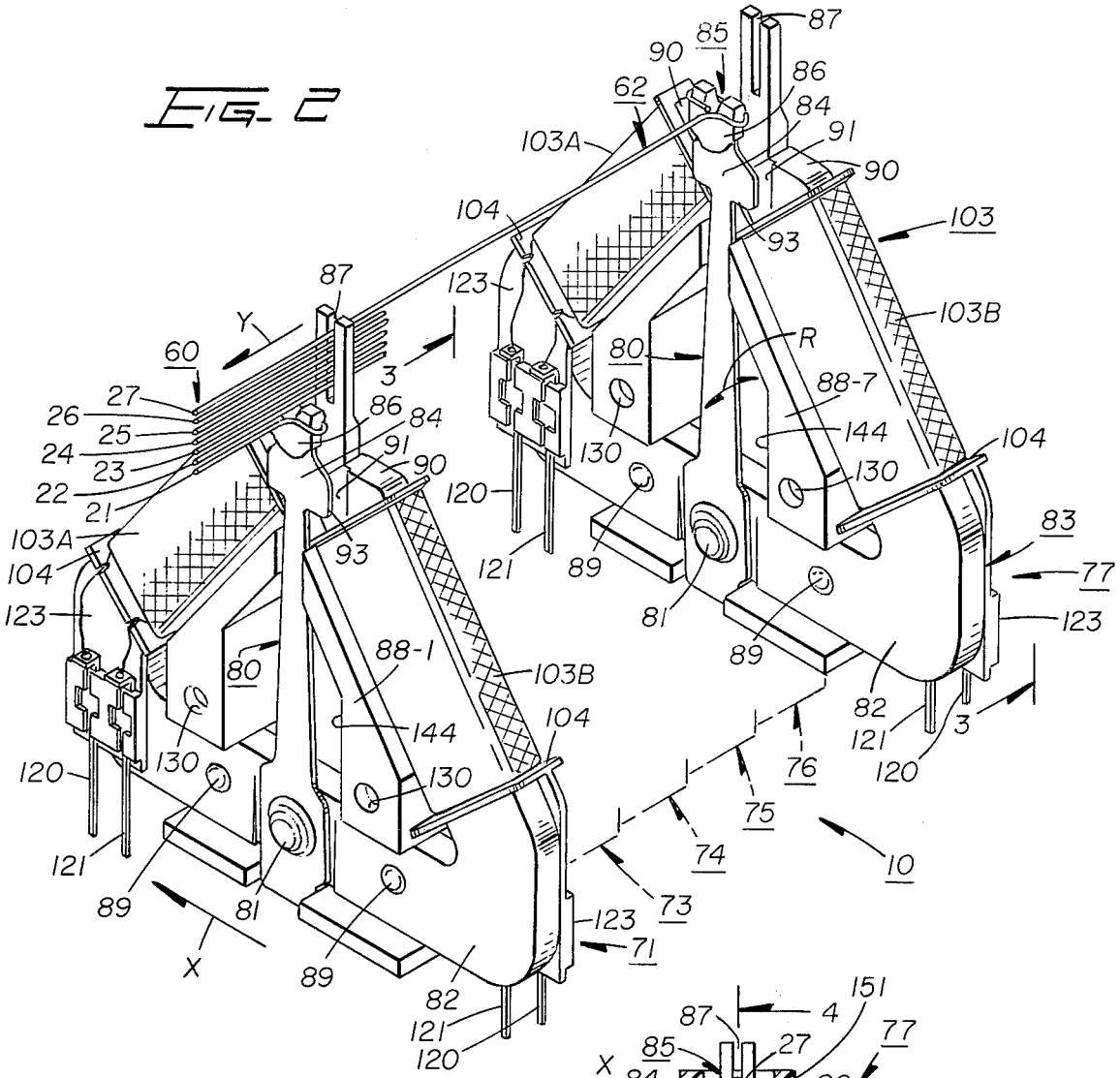
FIG. 2 is an enlarged fragmentary perspective view of a portion of the print head, looking from the paper toward the print head, from the left-rear in FIG. 1 generally along line 2—2.

The wires 21–27 are of uniformly increasing lengths, proceeding upward from the bottom wire 21 to the top wire 27, as indicated in FIGS. 2, 4 and 5. With this arrangement, plus the vertical spacing of the wires, the outer or actuator ends 62 of the successive wires from 21 to 27 define a horizontally spaced and vertically stepped configuration shown in FIGS. 2 and 4. In this example, the wire lengths vary uniformly from 0.40 inch for the bottom wire 21 to 2.10 inches for the top wire 27. This straight, essentially parallel, horizontal wire configuration, with horizontally spaced and vertically stepped outer ends 62 is very important in achieving a compact, light and economical print head assembly of closely spaced print wires, according to the invention, as will be discussed in more detail hereinafter. The wires 21–27 are required to reciprocate only short distances in a linear horizontal direction (Y), such as 0.035 inch, and thus the wire lengths are made as short as may practically be obtained.

Referring particularly to FIGS. 4 and 6, the wires 21–27 are mounted along their inner or printing ends 60 for precise horizontal reciprocation in a guide block 65 made of an acetal resin, or other low-friction material, and having a set of seven closely-spaced, vertically aligned horizontal bores 66 within which the ends of the wires 21–27 are received with a relatively close-tolerance sliding fit. The arrangement of the lowermost three bores 66, for the bottom wires 21, 22 and 23, is shown in FIG. 6. The guide block bores 66 set the final wire positions and thus the vertical spacing of the dots 30 making up the printed characters, as shown in FIG. 5 (0.003 inch in the specific example of 0.013 inch wires on 0.016 inch centers). Preferably, the guide block bores 66 fit the wires sufficiently closely to scrape ink and dirt from the wire ends, thus preventing migration along the wires which would cause stickiness.

The guide block 65 is secured to a front mounting plate 67 for the print head 10, and projects from the plate 67 toward the platen 51, as illustrated in FIGS. 1 and 4. An upper portion of the plate 67 is provided with a vertical slot 68 for guiding the print wires 21–27, in vertical alignment, into the bores 66 in the guide block 65. In effect, the slot 68 forms a continuation of the bores 66 to maintain the wires in the preset vertical printing plane, but imposes no vertical constraint on the print wires 21–27 prior to entry into the bores 66. The front mounting plate 67 and a corresponding rear mounting plate 69 for the print head are fastened to the top of the carriage 11 in a prescribed location as shown in FIGS. 1 and 4. The mounting plates 67 and 69 constitute two portions of a cage-like mounting assembly 70 for the print head 10, other portions of which will be described hereafter. The plates 67 and 69 and other parts of the supporting structure are also made of an insulating plastic, such as an acetal resin.

Actuator Mechanisms and Assembly for the Print Wires

Each of the wires 21–27 is mounted near its outer end 62 to a corresponding, individual electromagnetic actuator mechanism 71–77. The actuator mechanisms 71–77 normally cock or retract the associated print wires 21–27 (bias them to the right in FIGS. 2, 4 and 5), and then selectively "fire" each individual wire 21–27 when it is required for printing (drive it to the left to print). The actuators 71–77 are arranged in a compact, horizontally spaced and vertically stepped array corresponding exactly to the array of the outer ends 62 of the wires, as previously described. For example, the actuator 71 is lowermost and closest to the platen 51, while the actuator 77 is uppermost and furthest from the platen 51, as indicated in FIGS. 2 and 4.

Each electromagnetic actuator mechanism 71–77 is of identical construction and assembly, except for its elevation and distance from the platen 51. Considering as a typical example the outermost actuator 77 illustrated in FIGS. 2, 3 and 8–9, it includes a flat spring reed 80 of ferromagnetic material, which serves as an armature of the actuator 77. The reed 80 is fixed at one end, the base or lower end in the arrangement shown in FIGS. 2–4, and the other end is free to flex about the fixed end. In the example, the lower end of the reed 80 is secured by a rivet 81 to a base leg 82 of a thin, flat electromagnet core member 83, as illustrated in FIGS. 2, 3 and 8–9. The free end of each reed 80 is free to swing or flex in an arcuate path (arrow R) toward and away from the platen 51, as illustrated in FIG. 5, from a cocked or latched position shown at the right in FIG. 5 for the second lowest print wire 22, to a "fired" or printing position shown at the left for the lowermost print wire 21. As will be explained in more detail hereafter, each reed 80 first flexes to the right about its fixed mounting 81 to the latched position when the associated core 83 is magnetically energized in a first or "forward" direction, and then flexes to the left to print, powered by the potential energy stored in the spring reed 80, when the core 83 is momentarily demagnetized on receipt of a print signal for that wire.

Each print wire 21–27 is coupled near its outer end 62 to an upper end portion 84 of the associated reed 80 by a flexible coupling 85, so that the flexing movement (R) of the reed 80 causes essentially linear reciprocation of the selected wire 21–27 in the guide block 65, first to print and then quickly to reposition the actuated wire after printing and relatch it, as illustrated in the two positions in FIG. 5.

Referring to FIGS. 6 and 7, the coupling 85 for connecting the lowermost print wire 21 to its reed 80 is shown in detail, it being understood that all of the other couplings 85 are the same. The outer end 62 of the wire 21 is bent into a loop as shown in FIGS. 6 and 7, and is coupled to a plastic insert or tip 86, which has previously been mounted or formed on the upper end 84 of the reed 80. The loop of the wire 21 is mechanically coupled, as will be explained hereafter, to mount the wire 21 on the tip of the reed 80 at the desired altitude; that is, essentially horizontally and aligned with the corresponding bore 66 in the guide block 65. The plastic mounting tip 86 and wire loop construction 62 permits the body of the print wire 21 to reciprocate essentially horizontally in the printing direction (arrow Y) while the upper end 84 of the reed flexes in an arc, as previously described.

In the specific embodiment illustrated, the wire-mounting loop is formed in the horizontal plane of print wire reciprocation, as viewed from the top in FIG. 6, and has a modified elliptical configuration with outer and inner straight side legs 62A and 62B, shaped to fit the contours of the plastic tip 86 with an expansion-spring fit, to physically couple the print wire 21 on the tip 86. For this purpose the tip 86 is formed with a horizontal, semicircular groove 86A along its outer surface (that opposite to the platen 51) to receive and locate the outer side leg 62A of the loop.

To assemble the print wire end 62 on the plastic tip 86, the outer leg 62A is first inserted over the top of the tip 86 at an angle from above, such as indicated by the phantom-line position designated 21' in FIG. 7. On assembly, the outer leg 62A slides over a tapered entry surface 86B formed at the top-right hand corner of the tip 86, as viewed in FIGS. 6 and 7, and then enters the groove 86A, with curved end portions 62C, 62D sliding over and fitting around the front and rear flat ends 86C and 86D of the tip 86, as illustrated in FIG. 6. Then, the wire 21 is pivoted counterclockwise downward about the groove 86A, as indicated by the phantom arrow in FIG. 5A, at which time the inner side leg 62B slides over a tapered camming surface 86E formed along the upper left corner surface of the plastic tip 86. This stretches the loop in the horizontal direction Y so that the side legs 62A and 62B fit snugly on and grip the opposed vertical surfaces of the tip 86 (arrow F); that is, the inner wall of the groove 86A and a portion of the flat inner wall 86F immediately opposite to the groove 86A.

Thus, the print wire 21 is easily inserted on the reed 80 with a snap-on fit, and may readily be removed, when it is desired to replace a print wire or for other reasons. When assembled, the print wire 21 is flexibly coupled by the spring action of the wire loop to the reed tip 84 for essentially horizontal reciprocating movement (arrow Y) upon arcuate flexing of the reed in accordance with arrow R. The inner leg 62B can adjust its position vertically along the flat plastic surface 86F, as required to accommodate this movement.

The plastic tip 86 is secured atop the reed 80 in any convenient manner, preferably by molding it in place on the upper end 84 in a molding operation. The material of the tip 86 can be any suitable thermoplastic, preferably with relatively wear-resistant properties to accommodate the assembly and flexing of the print wire 21. For ease in molding, the reed upper end 84 is formed with a transverse mounting hole 84A below the upper end, through which the plastic flows during molding to form a rivet portion 86G, which connects the inner and outer sides of the tip 86 together and thus fastens the tip 86 on the reed 80.

The plastic tip 86 is also formed with a central, horizontal, semicircular groove 86H in its top surface running in the Y or printing direction. As illustrated in FIGS. 6 and 7, the next higher print wire, such as 22 in those figures, is received in the groove 86H out of contact with the tip 86.

Figure 15:
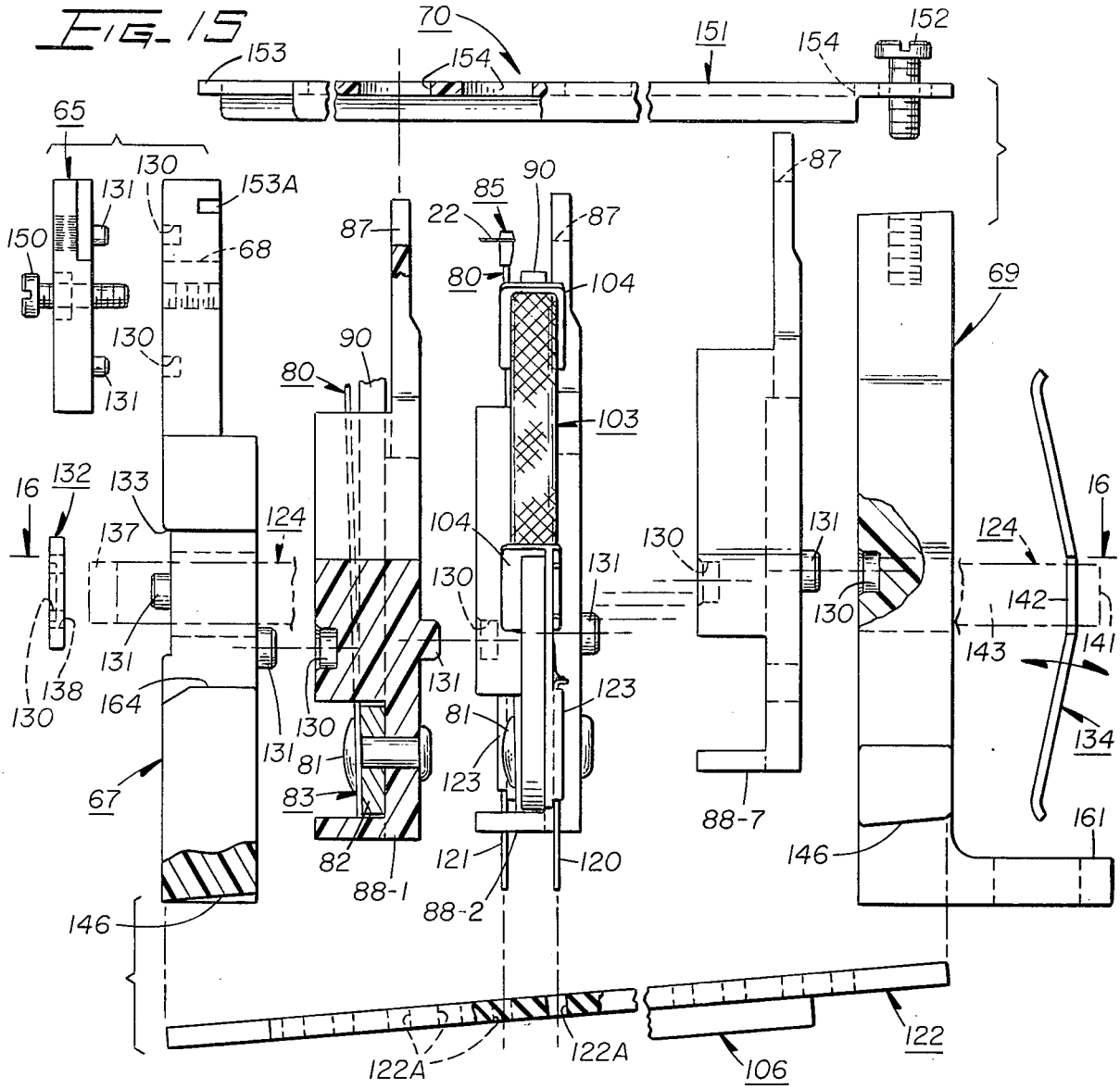
FIG. 15 is an exploded detail view showing the principal members used in mounting the print wires and actuating structure in the assembly of the print head, taken generally from the side as in FIG. 4 and with some parts in section.
Figure 16:
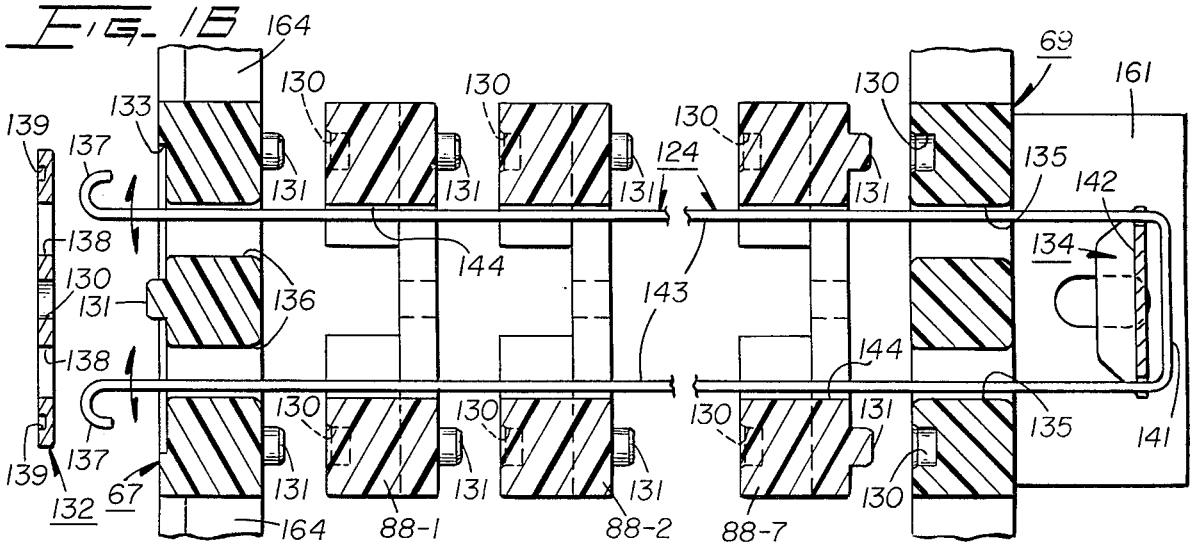
FIG. 16 is an exploded section along line 16—16 of FIG. 15.

The print wires 21–27 are unsupported vertically in the stretches between the couplings 85 on the reed tips 86 and the corresponding bore 66 in the guide block, each higher wire in the sequence from 22 to 27 passing through the groove 86H and above the tip 86 of each previous reed 80 in the sequence, as depicted in FIGS. 4 and 6. In the open stretches between the mounts 85 and the guide block 65, the wires 21–27 are guided in the transverse horizontal direction X by the slot 68 in the front plate 67, as previously described. Further, all wires 22–27 above the bottom wire 21 are guided by vertical slots 87 formed at the top of a set of seven mounting plates or panels 88 for the magnet cores 83 and for the other portions of the actuator assemblies 71–77, as will be described hereafter. Three mounting panels 88 are also illustrated in FIGS. 15 and 16, designated 88-1, 88-2, and 88-7. The panels 88 are individually designated 88-1 to 88-7, when referred to individually, corresponding to the seven print wires 21–27 and actuator mechanisms 71–77 they mount. As best illustrated in FIGS. 2 and 4, each print wire above 21 (the lowermost wire) passes through an increasing number of the guide slots 87 associated with the previous panels so as to confine all of the wires, particularly the longer ones such as 27, against lateral displacement from the desired line of reciprocation (arrow Y).

Figure 3:
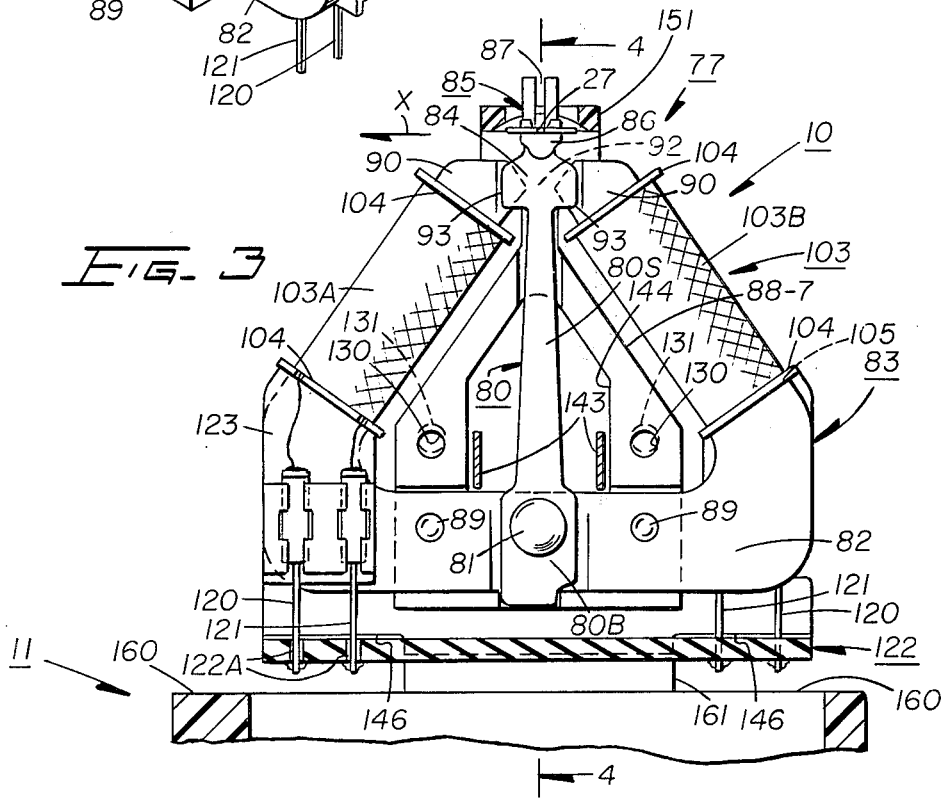
FIG. 3 is a vertical section along line 3—3 of FIG. 2, illustrating one actuating mechanism for a print wire.

Returning to the description of the electromagnetic actuators 71–77, each of the electromagnet cores 83 is secured to an adjacent mounting panel 88, as by rivets 89 (FIGS. 2 and 3), in a vertical plane and so that the base leg 82 of the core 83 is arranged horizontally along the bottom of the assembly at the preset elevation for the reed 80 mounted thereto. Each core 83 consists of a thin flat member or plate, when viewed from the side as in FIGS. 4 and 9, having a pair of spaced arms 90—90 which taper inwardly from the ends of the base leg 82 toward each other, as best illustrated in FIGS. 3 and 6. The areas A-B-C-D at the inner facing tips of the core arms 90—90 define spaced pole faces 91—91 of a magnet, when the core 83 is magnetized as will be described hereafter. The pole faces 91—91 are separated by an air gap 92, defined by the space between the inner tips D-D of the arms 90—90.

Figure 9:
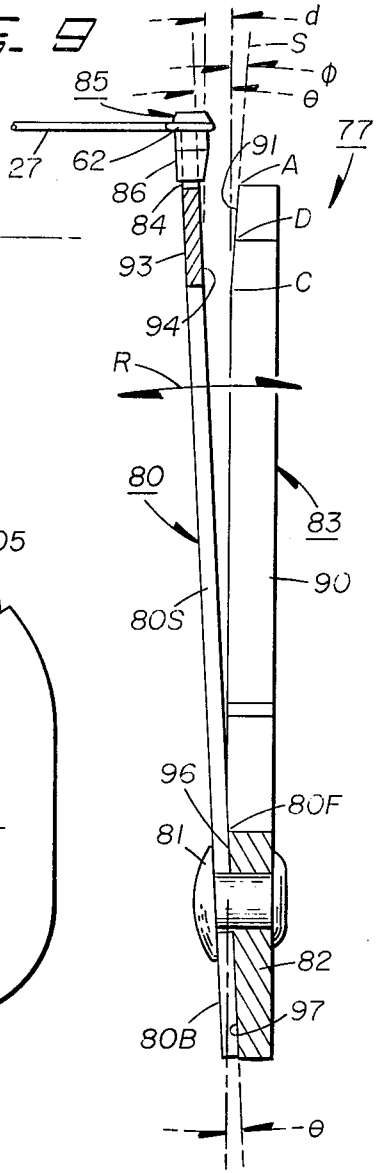
FIG. 9 is a vertical section through the core and reed along line 9—9 of FIG. 8, showing the reed in a neutral, non-energized position.
Figure 8:
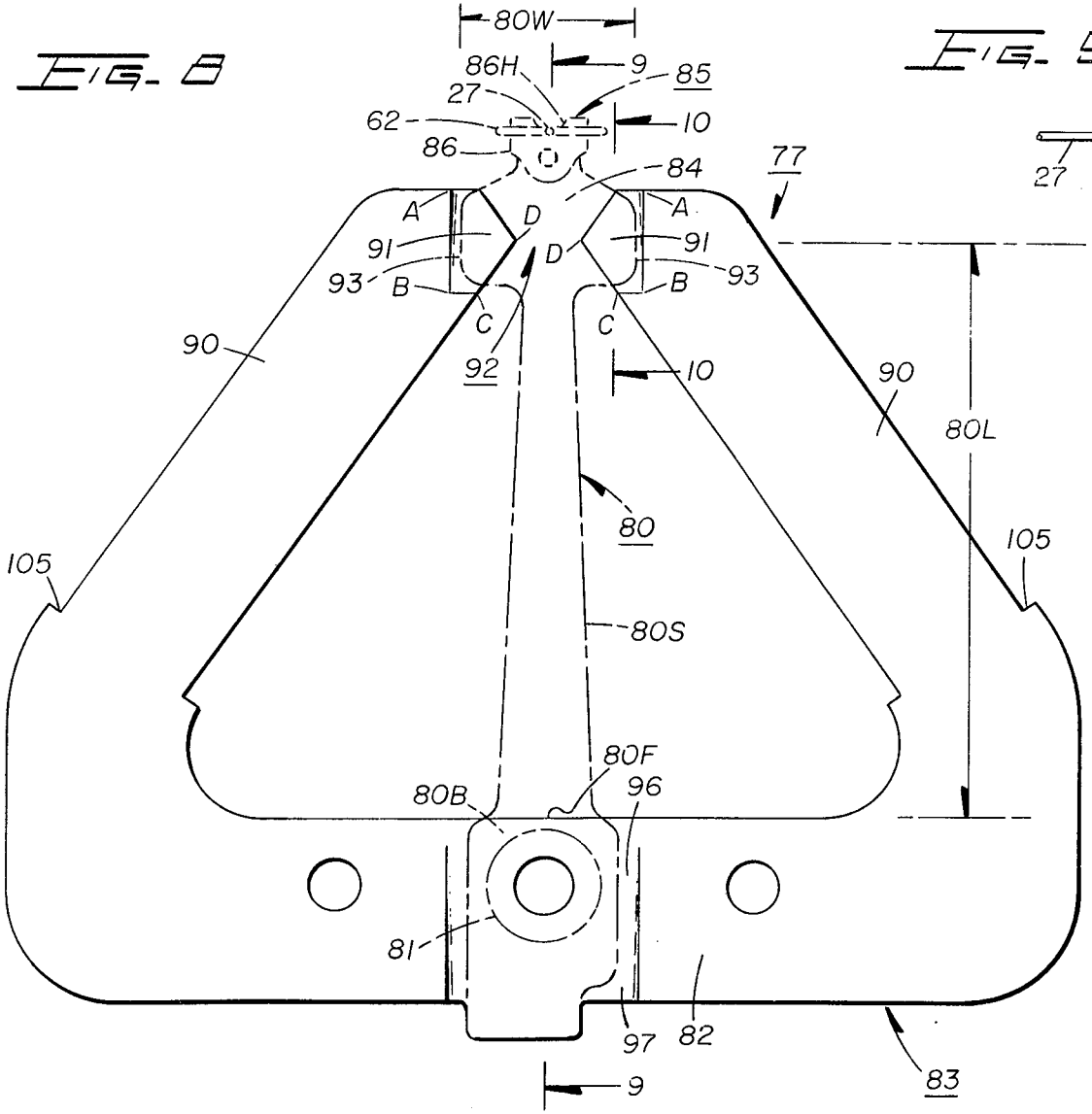
FIG. 8 is an enlarged detail view of an electromagnetic core member used in actuating a print wire, viewed in the same plane as FIG. 3, with an armature reed shown in phantom lines.

The pole faces 91 and gap 92 are aligned opposite to a crossarm portion 93 of the companion reed 80, which is formed just below the upper end 84 of the reed, as illustrated in FIGS. 3, 8 and 9 and which functions as the magnet armature. Each core 83 preferably has a generally triangular C-shaped configuration, when viewed from the front as in FIGS. 3 and 8, with the base leg 82 mounted horizontally at the bottom and the air gap 92 at the top, centered over the mounting rivet 81 for the reed 80.

Figure 10:
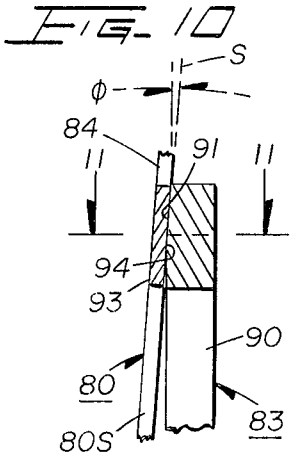
FIG. 10 is a fragmentary sectional view along line 10—10 of FIG. 8, showing the reed in a latched position against the core.
Figure 11:
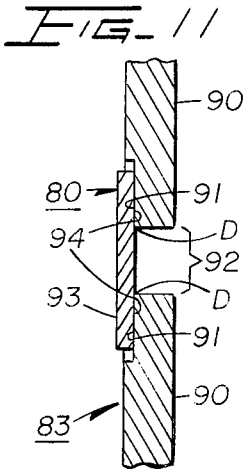
FIG. 11 is a top sectional view along line 11—11 of FIG. 10.

Prior to each printing step, each core 83 is magnetized, as will be explained hereafter, sufficiently to attract the crossarm 93 against the pole faces 91, thus latching the reed 80 in a cocked position against the pole faces 91, as shown in FIGS. 10 and 11 and at the right in FIG. 5. To assure a solid, stable latched position, the reed 80 and core 83 are so positioned with respect to each other, and the pole faces 91 are so located with respect to the facing, outer flat surfaces 94 of the crossbar 93, that the surfaces 94 of the crossbar 93 lie perfectly flat against the mating areas of the pole faces 91 when the spring reed 80 has been flexed to the latched position. Thus, the pole faces 91—91 are formed along inner flat surfaces of the thin flat core 83. This magnetically seals the reed 80 against the core 83, and closes the air gap 92 as shown in FIG. 11.

To properly position the reed 80 with respect to the core 83, the reed 80 is mounted at its fixed lower end so that the inner surface 94 of the crossbar 93 is spaced a predetermined distance $d$ (FIG. 9) from the pole faces 91, when the core 90 is not magnetized. Preferably, this is done by mounting the reed 80 at a small angle $\theta$, FIG. 9, with respect to the core, so that the reed in a neutral, nonenergized position tilts forward toward the platen 51 and the crossarm 93 is thus spaced the desired neutral distance $d$ from the pole faces 91. In one typical example, the angle $\theta$ is 1½° and the distance $d$ is approximately 0.040 inch.

This mounting is conveniently accomplished by forming a reed-mounting area 96 at the center of the base leg 82 of the core with a downwardly bevelled surface 97 (FIG. 9), as by swaging. The angle ($\theta$) of the bevel 97 is essentially the same as the angle of inclination $\theta$ at the top, thus simply providing the required neutral spacing $d$. The spacing $d$ is set so that (1), when the core 83 is magnetized, the crossarm 93 of the reed 80 is easily and quickly attracted to the pole faces 91 to seal and latch, and (2) the reed's spring body is bowed sufficiently to propel the reed with the desired force required in printing.

When the reed 80 cocks, the free end bows backward toward the core 83, as depicted in FIGS. 5 and 10, preferably past the vertical and with the reed body or stem bowed in a retroflex curve as depicted in FIG. 5.

To accommodate this curvature, the facing inner surface area A-B-C-D (FIG. 8) of the pole faces 91 is bevelled away from the reed 80 at a small reverse angle $\phi$ to the vertical, as indicated by the line S in FIGS. 9 and 10, such as 1½° in a typical example. The angle $\phi$ is chosen, in correlation with $\theta$, so that the overlapping portions of the reed-latching surfaces 94 lie perfectly flat against the tapered pole surfaces A-B-C-D, as shown in FIGS. 10 and 11, and preferably the angle $\theta$ is set approximately equal to the angle $\phi$. Of course, the combination of the angles $\theta$ and $\phi$ sets the magnitude of the spring force or power available to be released when the core 83 is ultimately demagnetized to fire the reed.

Preferably, the reeds 80 comprise generally *t*-shaped members, when viewed from the front or the work station side (platen 51) as in FIGS. 3 and 8. As used herein *t*-shaped means shaped like a Latin cross, that is, having a base leg or body 80*s*, a crossarm 93 and an upper tip 84 extending above the crossarm, the base leg 80*s* being longer than the upper tip 84 (FIGS. 2 and 3). From the side of the *t*, as viewed in FIGS. 4 and 9, the reeds 80 comprise relatively thin, flat plates of such material and thickness that the body or stem (80S) of the reed comprises a leaf spring capable of the flexing movement just described, to cock and fire the companion print wires 21–27. The reed is preferably fabricated of a ferromagnetic spring steel as previously described.

The reeds 80 are mounted so that the base 80B of the reed is fixed, as by the rivet 81; the tip 84 of the *t* is free to flex toward and away from the work station; and the crossarm 93 faces the work station and is generally perpendicular to the line of flexing of the reed 80. In the specific embodiment of the invention illustrated, where the line of print wire reciprocation is essentially horizontal, each reed 80 is mounted and arranged generally vertically (plus or minus angle $\phi$ or $\theta$ depending on the state) as previously described and as shown in FIGS. 2 and 8. In this example, the base 80B of the *t* is down and is fixed by the rivet 81; the tip 84 of the *t* is aligned with and coupled to the inner end 62 of the companion print wire, as previously described; and the crossarm 93 is generally horizontal and perpendicular to the plane of the column of print wires, as viewed in FIG. 2. The reeds 80 are preferably also mounted in the horizontally spaced and vertically stepped array, as illustrated in FIGS. 2 and 4, corresponding precisely to that defined by the outer ends 62 of the associated print wires 21–27 in the specific embodiment illustrated of a matrix printer.

Preferably, the stem 80S of each reed 80 tapers inwardly from the base 80B to the crossarm 93, looking from the front of the *t* as viewed in FIGS. 3 and 8, with the narrowest portion of the stem 80S located just below the crossarm 93. This taper contributes to easy flexing movement of the reed 80 for a given material, thickness, and operating length 80L (this being the distance from the mounting of the base portion 80B where the reed begins to flex up to the center of the crossarm 93) and serves to minimize mechanical stress in the reed 80. The base 80B of the *t* may be enlarged below the flexing point, as illustrated in FIG. 8, for firm attachment to its support (base leg 82 of the core 83 in the example). As viewed in FIGS. 8 and 9, the stem 80S flexes about a sharp edge or line 80F along the upper edge of the mounting leg 82 of the core 83.

The working length 80L of the reed 80, from flexing axis 80F to the center of the crossbar 93, is set in accordance with the spring properties and pole-to-crossarm spacing *d* to obtain the desired spring force on firing to print the characters. In a typical example as shown in the drawings, the reed length 80L is approximately one inch. To achieve a small and compact print head 10 as described, the length and width of the reed 80 are minimized to the extent practical, as with a typical length of one inch, neutral spacing *d* of 0.04 inch, and total flex angle $\theta + \phi$ of about 3°.

The length and width of the reed tip 84, above the crossbar 93, is not critical to operation, and may be whatever size is convenient to couple the print wire 21–27 or other workpiece to the tip. Where an array of closely spaced workpieces are involved, such as the closely spaced print wires 21–27, then the height of the tip should be as small as is practicable so that each reed 80 in the array will not interfere with the movement of the next higher print wire, as previously described. The width of crossarm (80W, FIG. 8) is dictated by the shape and spacing of the pole faces 91—91 of the core 83. The crossarm 93 must have sufficient width to span the air gap 92, and sufficient length and width to provide overlapping areas with the pole faces to effectively seal the reed in the latched position, as will be described in more detail hereafter. Further details of the electro-magnetic theory, and preferred pole geometry of the reed and core are explained hereafter.

Instead of tilting forward at the initial angle $\theta$, the reed 80 can be mounted vertically in the neutral position, spaced from and parallel to the core 83. In this case, the facing surfaces of the pole faces 91 are bevelled backward at a greater angle $\phi$, as required to set the desired cocking angle so that the crossarm 93 fits flush against the pole faces 91. In either case, the object is to achieve a flush fit between the crossarm 93 and pole faces 91 in the cocked or latched position of the reed 80, to magnetically seal the reed and core.

To properly position the print wires 21–27 in the latched or "ready" positions preparatory to firing, the cores 83 are arrayed in parallel vertical planes (FIGS. 2 and 4), and are spaced from each other in the Y direction the same distances as the reeds 80 and the drive ends 62 of the print wires 21–27. The cores 83 are also vertically stepped in the Z direction, exactly in accordance with the stepping of the associated reeds 80 and wire drive ends 62, so that the pole faces 91 of each successive actuator unit 71–77 are located approximately the same distance above the preceding unit as the vertical spacing between adjacent print wires 21–27. The spacing of each successive core 83 from the platen 51, to the right in FIG. 4, determines the length of the associated print wire 21–27 and sets the latched or cocked position, where each print wire is ready to be fired.

Operation of Electromagnetic Actuators 71–77

To selectively cock and then fire the print wires 21 to 27, each magnet core 83 is provided with an individual electrical coil 103 for selectively magnetizing and demagnetizing the corresponding core 83, to repetitively latch and then release the corresponding reed 80 when printing is required. Preferably, each coil 103 consists of two equal individual windings 103-A and 103-B, preferably connected in series and positioned one on each of the sloping core arms 90—90, as illustrated in FIGS. 2 and 3.

The inwardly sloping, triangularly disposed core arms 90—90 have a rectangular cross section, which is very useful in assembling the windings 103A-103B, with the core 83, in that the windings can be separately wound on plastic bobbins 104 (FIG. 3) having rectangular central openings or mounting holes shaped to fit over the outer ends of the arms 90, and then can be slipped over the open ends of the arms to a rest position on a corresponding shoulder or flange 105 (FIGS. 3 and 8) formed near the base of the arms 90.

Figure 12:
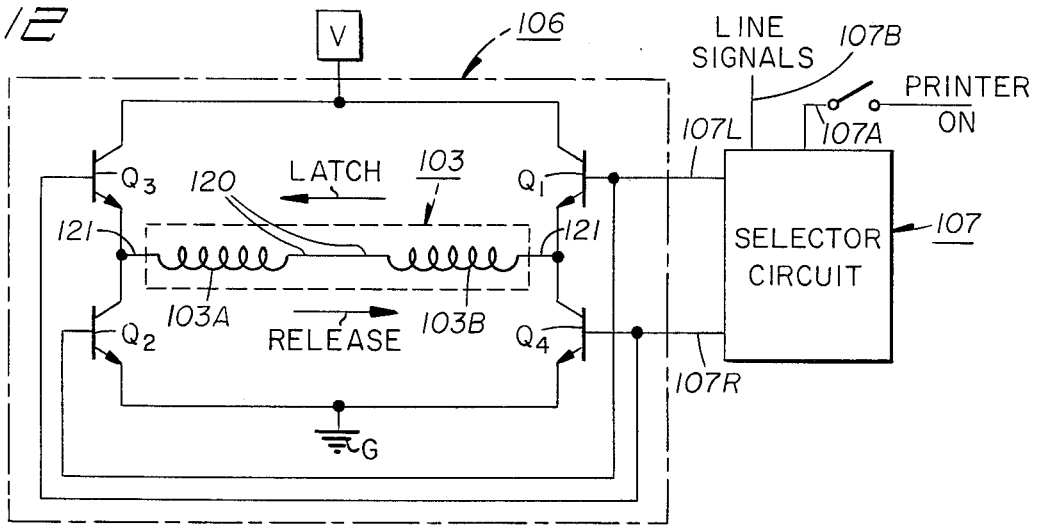
FIG. 12 is a schematic electrical circuit diagram illustating operating circuits for latching and firing the print wires.
Figure 13A:
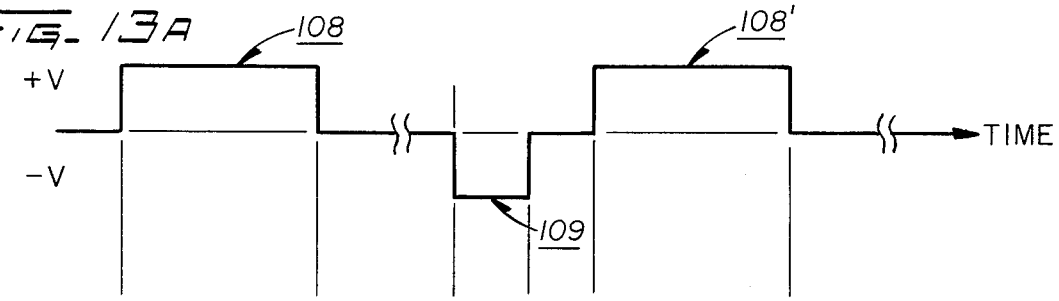
FIGS. 13A and 13B are electrical pulse diagrams, illustrating the latching and firing voltage pulses in FIG. 13A and the induced current pulses in FIG. 13B.

Referring to the simplified circuit diagram in FIG. 12, the coil 103 (windings 103A and 103B connected in series) of each actuator unit 71–77 is selectively connected in either a forward or "latch" direction, or in a reverse or "release" direction, to a voltage source V for preset time intervals illustrated in FIGS. 13A and B, to latch and then release or fire the associated print wire 21 to 27. Alternatively, the windings 103A and 103B can be connected in parallel and simultaneously energized, where desirable. In the example illustrated in FIG. 12, the control circuit includes a generally conventional bridge driver circuit 106 that is triggered by a selector circuit 107 of any known type. Selector circuits of this general type are well known, and form no part of the present invention, thus it will not be described in detail herein. In general, to latch the print wires 21–27 in preparation for a print signal, a "pull-up" or latching pulse 108 (FIGS. 13A and B) from the source V is applied to the coil 103 in the forward or latching direction, and to fire the print wire a release pulse 109 is applied in the reverse direction.

In the typical operating circuit shown in FIG. 12, when the printer is first turned ON, a "printer ON" input lead 107A actuates the selector circuit 107 to generate a "latch" output signal at a first output terminal 107L for a time interval $t_1$ to $t_2$ in FIGS. 13A and B. This turns ON a first pair of switching transistors $Q_1$, $Q_2$, of the driver circuit 106, which in turn connects the supply voltage V to ground G through the coil 103 in the forward or latching direction, designated +V in FIG. 13A.

Figure 13B:
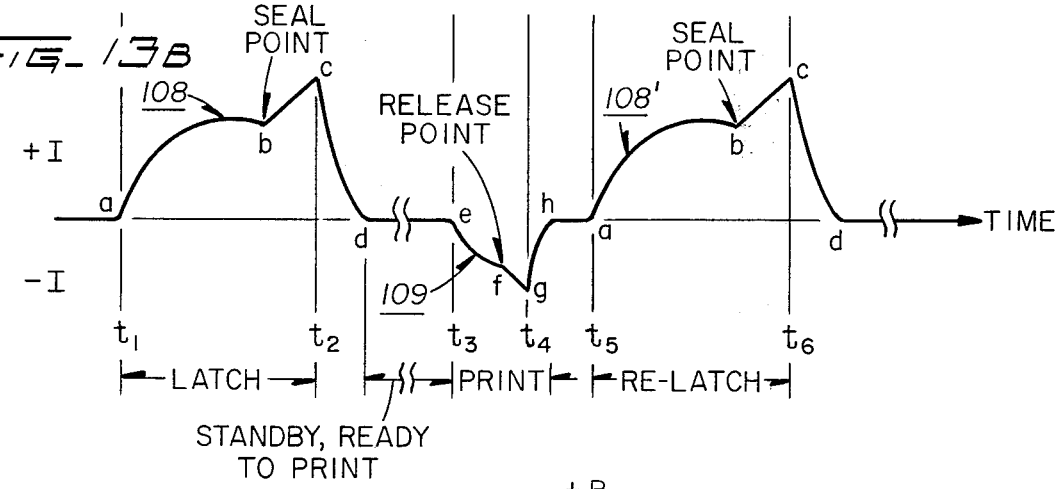

The current pulse induced in the coil 103 when a latch pulse is applied is illustrated by the curve 108 in FIG. 13B. From a starting point 108*a* (zero current), current flow increases in the +I or latching direction to point 108*b* along curve 108*a–b*. Point 108*b* is the "seal point," at which the reed 80 seals against the core 83 and the air gap 92 is closed by the reed. At point *b*, the current jumps sharply to a point 108*c*. At time $t_2$, the transistors $Q_1$ and $Q_2$ are turned OFF by the selector circuit 107, to terminate the voltage pulse as shown in FIG. 13A and the current pulse 108 then quickly falls to zero along line 108*c–d*. When the machine is first turned ON, such a latching pulse 108 is applied to the coils 103 of all seven actuators 71–77 in parallel, so as to insure positive latching of all seven reeds 80 prior to receipt of the first print signal.

The latching or pull-up pulse 108 magnetizes each core 83, such that the core 83, in effect, becomes a permanent magnet of a given polarity after latching, as will be described. The material selected for the core 83 is a highly retentive magnetizable material, preferably a high-carbon tool steel having properties of high residual induction, low coercive force, and high permeability when subjected to an external electromagnet field. Typical examples of preferred materials are described in F. A. Zupa U.S. Pat. No. 3,128,418 and an article "Magnetic Latching Crossbar Switches," by F. A. Zupa, appearing in *The Bell System Technical Journal*, September, 1960, pp. 1351–1374, both herein incorporated by reference. One preferred example is ASTM "W2 Tool Steel," a tool steel with approximately 1% carbon, 0.2% manganese, and 0.2% vanadium. The Zupa patent and article provide further detail on selection of materials, operating magnetic theory, and typical operating parameters for this type of system. By using such material for the core 83, a single pull-up pulse 108 in effect converts the core 83 into a permanent magnet for an indefinitely long period of time, far longer than any cycle of operation encountered in the use of the printer.

Figure 14:
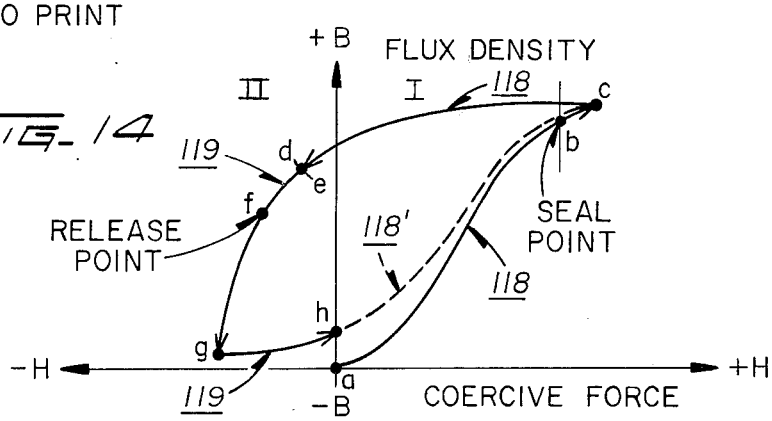
FIG. 14 is a B–H diagram, illustrating the magnetization and demagnetization curves for a typical magnet core in latching, firing and relatching the reed and print wire.

FIG. 14 illustrates a typical operational B–H curve for such a core 83, wherein the curve 118*a-b-c-d* indicates the magnetization (flux density B) of the core following the application of the electrical current pulse 108 in FIG. 13B in a +H or latching direction. (In conventional terminology, H indicates the applied coercive force, which is proportional to the applied current and also varies with other factors not here pertinent as to the main operating principles of the actuator.) The initial magnetization curve, starting from a virgin zero point 118*a*, follows a typical electromagnetic magnetization curve 118*a–b* up to the seal point 118*b*, when the air gap is closed. After this, further increase in current 108*b–c* has little effect in increasing the magnetic strength (+B), which rises to point 118C. As the applied current falls to zero along curve 108*c–d*, the magnetic strength falls slightly from point 118*c* to 118*d*, and the coercive force passes into the −H region to point 118*d*, in quadrent II, which is typical of permanent magnets. At point 118*d*, the core 83 is permanently magnetized, as described in the Zupa literature, and will thereafter hold the reed 80 latched virtually indefinitely, as indicated by the broken lines along the time axis in FIGS. 13A and B, thus storing potential energy in the cocked spring reed 80 for the printing operation, when the companion print wire 21–27 is later selected for printing.

When any one or all of the print wires 21–27 is selected for printing, the release or "print" pulse 109 (FIGS. 13A and B) is momentarily applied to the associated coil 103, as described in the Zupa patent and article. In the circuit of FIG. 12, an incoming "print" line signal on input 107B to the selector circuit 107 actuates a "release" terminal 107R, which turns ON a second pair of switching transistors $Q_3$, $Q_4$, which then serve to connect the coil 103 to the voltage source V and ground G in the reverse or "release" direction, so that the induced current pulse 109 (FIGS. 13A and B) flows through the coil in the reverse direction, designated as −V and −I in FIGS. 13A and B. The reverse voltage pulse 109 (FIG. 13A) is applied to the coil for a second preset time interval $t_3$ to $t_4$, which is far shorter than the latching pulse 108 time $t_1$ to $t_2$. A typical release current pulse 109 so induced is illustrated in FIG. 13B, with the corresponding operational B–H curve 119 being illustrated in FIG. 14. As the release current increases from point 109*e* (zero) toward maximum release current 109*g*, the core 83 is demagnetized (driven in the −B direction) along curve 119*e–g*. (Note that the magnetic starting point 119*e* is essentially the same as the end point 118*d* of the magnetization curve over long periods of time, since the core is essentially a permanent magnet during this standby time interval between the end of the latching pulse 108 and the start of a release pulse 109.) At some point along this curve 119*e–g*, designated point f, the magnetic strength B of the core 83 is reduced to the point where it can no longer hold the cocked spring reed 80, after which the spring reed body takes over and rapidly drives the selected print wire 21–27 to the left in FIGS. 2, 4 and 5 so as to print the desired dot 30, as previously described.

The release pulse 109 persists momentarily after firing, line 109*f–g* (FIG. 13B), and then is promptly terminated at time $t_4$ (line 109*g–h*), as soon as possible after one is certain that the reed 80 has been fired. In a typical example, the release pulse 109 lasts about 3/4 of 1 millisecond (time $t_3$ to $t_4$). The B–H operational demagnetization curve 119 for the core 83, following the release point 119*f* is depicted in FIG. 14, with points 119 *f-g-h* following current levels 109 *f-g-h* in FIG. 138B. Note, from FIG. 14, that it is not necessary, nor is it desirable, to actually reverse the polarity of the pole faces 91 (which would be indicated by negative B), or even to drive the core to zero magnetism (the H axis). Preferably, the demagnetization curve 119 is retained in quandrant II of the curve, plus B and −H. It is only desirable to surely drive the curve +B low enough to be assured that the reed 80 has been released (point 119*f*), after which the reverse pulse 109 is superfluous and is promptly terminated by the selector circuit 107.

After a very short delay time $t_4$ to $t_5$, typically ¼ of 1 millisecond, a second pull-up or "restore" pulse 108′ is reapplied by the selector circuit 107 (times $t_5$ to $t_6$), so as to switch the core 83 back to its normal magnetized state, thus to attract the reed 80 back to the cocked position and to relatch it after printing only one dot. This prompt relatching eliminates any rebound problem and serves to promptly reposition the actuated print wire 21 to 27 in preparation for a following printing step in a subsequent column (*a*)–(*e*), FIG. 5, along the paper 12. The core 83 follows a similar B-H curve 118′, shown in dotted lines, during each relatching or restoring cycle to $t_5$ to $t_6$, and each core is thereafter repetitively cycled with "print" and "restore" pulses such as 109 and 108′ whenever needed for printing. As previously mentioned, the core material is a permanent magnet, once magnetized by one of the latching or restore pulses 108 or 108′ and will remain magnetized practically indefinitely. Thus, the reeds 80 remain virtually permanently latched even if no print siganl is received for a long period of time, typically several days or more. Nonetheless to insure that all reeds 80 are properly latched prior to printing, with uniform magnetic strength, an initial latching pulse 108 is always applied when the printer is first turned on, as previously described.

In the specific example, the reeds 80 are fabricated of a suitable ferromagnetic material, such as low carbon steel. With this arrangement, and the proportions shown in the drawings, the upper ends of the reeds 80 can repetitively be latched and fired in a cycle time (curves 109 + 108′ in FIG. 13B) of just over three milliseconds, allowing needed margins, thus permitting extremely rapid on-the-fly printing at the rate of over 40 characters per second. In some examples, a total pulse cycle time (109 + 108′) as low as 1.8 milliseconds has been achieved with the materials described and the geometry illustrated; however, such extreme speed is not needed for most practical applications of the printer.

Optimum operating parameters for voltage, current, times, etc. are readily selected for particular systems desired, and of course must be correlated with the materials used, coil turns, and core to reed spacing and pole geometry. Typical examples of operating embodiments as shown in the drawings have been run with +40 volts d.c. as the power supply V, less than 0.2 amp peak current (point 108*c* in FIG. 13B), and about 2 watts continuous average power at normal printing speeds and conditions.

Pole Geometry and Electromagnetic Principles

The specific shape and geometry of the core 83 and its pole faces 91, and of the matching portions of the reed 80, are very significant in the practice of the invention. In particular, the core 83 is designed to act as a permanent magnet when latched, but as an electromagnet when attracting the reed 80. To maximize these effects, the core and pole faces have been specifically shaped to combine the best features of both permanent magnets and electromagnets in this type of system.

A permanent magnet, ideally, should have a small pole face area and preferably curved arms to concentrate the flux, as in a common horseshoe magnet. For a typical electromagnet of this general class, a rectangular E-shaped core is generally used, having large area flat pole faces facing the armature and with a comparatively much wider gap between the pole faces. This maximizes the electromagnetic attractive force.

In the subject design, the core 83 behaves as an electromagnet when attracting the reed 80 in the first instance and on relatching after each printing step. At this time, a relatively large effective pole area is provided, consisting of the generally triangular pole face areas A-B-C-D effective on latching (FIG. 8) and the fringe areas around the pole faces 91—91. But the bevelled pole faces 91—91 (line S, FIG. 10) limit the reed-contact area to the relatively small, generally triangular regions A-B-C-D after the gap 92 has been closed and the reed sealed, after which the core 83 functions as a permanent magnet. To maximize the permanent magnet effects in the present invention, the pole face area is shaped with the generally triangular armature contact area A-B-C-D shown in FIG. 8, which is also bevelled backward as shown in FIG. 7 at the angle $\phi$ to provide a minimum practical sealing contact area with the overlapping portions 94 of the armature crossbar 93. This is depicted in enlarged, slightly exaggerated fashion in FIGS. 10 and 11. The innermost regions D-D of the pole faces 91—91, forming the air gap 92, are pointed, as illustrated in FIG. 8, so as to increase the reluctance of the air gap 92. That is, corresponding vertices ADC of each pole face are located at the inner facing tips of the core arms 90—90. This in turn minimizes flux leakage across the gap 92. Preferably, the facing vertex angles ADC of the pole faces are indentical obtuse angles, being about 100° in a typical example illustrated.

The pointed pole face construction D—D, in combination with the linearly converging arm construction 90—90 further allows the pole faces 91—91 to be very closely spaced, as illustrated in FIG. 8. Thus, a practical minumum width can be set for the air gap 92 (distance D—D in FIGS. 8 and 11) for example, 1/16 inch in a typical embodiment, while still preserving the desired relatively high reluctance across the gap 92 as previously described. This enables the reed crossarm 93 length (80W) to be reduced to a practical minimum, which in turn reduces the reluctance of the crossarm 93, or armature of the magnet when latched. The net effect of this geometry is that, when the armature reed 80 is sealed, its reluctance (by comparison) is much lower than the reluctance across the air gap 92. Therefore, the core 83, acting as a permanent magnet and having limited flux, drives most of its flux through the armature crossarm 93 rather than wasting it across the gap 92.

In this construction, when the core 83 is acting as an electromagnet, the leakage across the gap 92 is greater than might otherwise be desired for best electromagnetic operation; but, since the magnetizing force +H of the energizing coil 103 is much greater than the permanent magnet force, this leakage is less important to the system than the reduction in armature reluctance permitted by the convergence of arms 90—90 when te system is acting as a permanent magnet.

Another important advantage of the thin, flat triangular core configuration is that it provides a small and compact array for the print head 10, as is evident from FIG. 1, and further it makes it possible for the operator of the printer to see each character shortly after printing, to the left of the left core arms 90, as viewed in FIGS. 1 and 5. This visibility feature is important when typing messages from a keyboard.

Assembly of Print Head 10

In order to assemble the individual actuator mechanisms 71–77 for the print wires 21–27 into the compact print head 10 as illustrated, each reed 80 and core 83 assembly is fastened to a corresponding actuator-mounting plate or panel 88-1 to 88-7, as shown in FIGS. 2, 3 and 4, and as previously described. Electrical leads for the windings 103A and 103B are wired to individual connector plugs 120–121, which project downward from the bottom of the print head assembly, as shown in FIGS. 3, 4 and 15 (for panel 88-2) and are received in sockets 122A in a printed circuit card 122 and soldered to conductors on the card in conventional fashion.

As illustrated in FIGS. 3, 4 and 15, the printed circuit card 122 fits along the bottom of the print head 10, and is preferably attached, as by adhesive bonding, to the bottom surfaces of the front and rear head-mounting panels or plates 67 and 69, which consist of flat plastic blocks similar to the actuator-mounting panels 88. Thus, the card 122 serves as a floor of the cage-like mounting assembly 70, as depicted in FIG. 15. Preferably, the connector plugs 120 and 121 are encapsulated in a flat plastic insert 123 (FIGS. 2, 3 and 15), which is an extension of the coil bobbin 104 as illustrated in FIGS. 3 and 15, and is shaped to fit along a sidewall of each core 83. The conductors on the printed circuit card 122 electrically connect two of the plugs at each side, such as two outer plugs 120—120, together so as to connect the windings 103A and B in series as illustrated schematically in FIG. 12. The seven adjacent mounting panels 88-1 to 88-7 are nested together in the vertically stepped configuration illustrated in FIGS. 2, 4, and 15, and previously described, and are fastened together with the front and rear mounting plates 67 and 69 by a generally U-shaped fastening band 124 shown from the top in FIG. 16.

To explain this assembly in more detail, FIGS. 15 and 16 illustrate the relation between three of the actuator-mounting plates (88-1, 88-2 and 88-7) to each other and to the front and rear head-mounting plates 67 and 69, with the plates shown in exploded relationship to each other and to the circuit card 122 prior to assembly. To mount these units, each mounting plate 88 in the sequence is provided with a pair of spaced cylindrical locating sockets 130 (also FIGS. 2 and 3) molded in one face, the inner or left face in the example illustrated. The sockets 130 receive a pair of mating cylindrical locating pins 131 formed on the outer or right face of the preceding mounting plate 88. Thus, each two successive plates in the row (such as 88-1 and 88-2 in FIGS. 15 and 16) can be nested together in the abutting positions shown in FIG. 4, in which each mounting plate 88 in the row orients and supports the following mounting plate to the right and positions it at exactly the precise altitude. The offset vertical spacing between the pins 131 and sockets 130 sets the vertical or Z position of each mounting plate 88 in the row with respect to the preceding one, and thus the desired spacing of the actuators 71–77 and the print wires 21–27 carried thereby.

Preferably, the mounting plates 88 are all identical moldings, which are fastened to identical cores 83 and reeds 80 to form a group of identical actuator subassemblies or modules, which on assembly become the actuator assemblies 71–77 based on their assembled position in the row, from position one to seven from the left in FIGS. 4 and 15.

Similarly, the front mounting plate 67 is formed with locating pins 131 for positioning the first mounting plate 88-1 (for print wire 21) at the required height, and the rear mounting plate 69 has locating sockets 130 so that the last and highest mounting plate 88-7 positions the rear mounting plate 69 in the assembly.

When the nine plates 67, 88-1 to 88-7, and 69 have been properly nested, as shown in FIg. 4, the band 124 (shown in FIG. 16 and in phantom lines in FIG. 15) is assembled with the unit to fasten it together. For this purpose, a band-retainer plate 132 is provided, which fits in a rectangular groove 133 in the left central surface of the front mounting plate 67 and is precisely positioned on an additional locating pin 131 projecting from the center of the plate 67 and receiving a mounting hole 130 through the center of the retainer plate 132. A spring or keeper plate 134 is positioned against the outer surface of the rear mounting plate 69 as illustrated in FIGS. 1, 4, 15 and 16.

To lock the mounting assembly 70 in place, after assembly of the plates 132, 67, 88, 69, and 134 as viewed in FIG. 4, the band 124 is threaded through the assembly from the right in FIGS. 4, 15 and 16, through spaced holes 135 in a central section of the rear mounting plate 69 and through aligned holes 136 in front plate 67. The band 124 has curved, C-shaped lead ends 137—137, which are inserted through the holes 135 and 136 and then through receiving holes 138—138 in the retainer plate 132. When the spring tips 137—137 of the band 124 clear the holes 138 in the retainer plate 132, they flex outwardly and then snap into place within spaced retaining grooves 139—139 in the retainer plate 132.

The spring keeper plate 134 is bowed, as shown in FIG. 15, and acts as a heavy leaf spring upon assembly of the unit with the band 124. For this purpose, an outer straight end 141 of the fastening band 124 is resiliently retained against a flat central section 142 of the keeper plate 134. With this arrangement, the keeper plate 134 exerts a force to the right in FIGS. 1, 15 and 16, holding the unit together with the fastening band tips 137 securely locked in the retainer plate grooves 139. Also, the bowed keeper plate 134 can accommodate slight differences in width of the stack of nine mounting plates 67m 88-1 to 88-7 and 69 and still fasten the units together into a rigid, locked cage-like assembly 70, as described previously. The fastening band 124 is generally a square U-shaped piece, including straight rectangular arms 143—143, which are received within a central aperture 144 of each of the mounting plates 88, as shown in FIGS. 3 and 16.

After the subassembly of plates 67, 88, 69, 132 and 134 has been locked together by the band 124, as illustrated in FIGS. 1 and 4, the sockets 122A in the printed circuit card 122 are threaded over the electrical plugs 120 and 121 for each coil 103, and the card is then cemented in place to mounting surfaces 146—146, which are formed along portions of the bottom surface of the front and rear mounting plates 67 and 69 as illustrated in FIGS. 4 and 15. The surfaces 146 are slanted at an angle dictated by the stepped configuration of the mounting plates 88, so that the circuit card 122 is mounted at an upwardly inclined angle from front to rear as illustrated in FIGS. 4 and 15. After cementing the crd 122 in place, the plugs 120 and 121 are soldered to the circuits on the card 122 in conventional fashion.

After this operation, the print wires 21 and 27 are then snapped in place on the tips of the reeds 80, as previously described and as illustrated in FIGS. 6–7, and the wires 21–27 are simultaneously lowered in sequence into slot 68 in the front mounting plate 67, and all but the lowest print wire 21 are lowered into the guide slots 87 in the previous mounting plates 88, as previously described and as illustrated in FIGS. 2, 4, and 6. Next, the wire guide block 65 is threaded on the inner ends of the print wires 21–27 and is fastened to the front plate 67, as previously described and as illustrated in FIGS. 1, 4 and 15. For this purpose, the front plate 67 is formed with two additional locating sockets 130 (FIG. 15) in its left face to receive and locate two mating pins 131 formed on the right face of the guide block 65, and a screw 150 is used to fasten the guide block 65 to the front plate 67.

Last, an upper cover 151 for the print wires is fastened atop the unit by a screw 152, as illustrated in FIGS. 1, 4, and 15, this cover being broken away at the right side in FIG. 4 to show details of the wire mountings. The left end of the cover 151 is formed with a projecting rectangular tip 153, which is received in a slot 153A formed in the right surface of the front mounting plate 67, as illustrated in FIG. 15, and the cover 151 is formed with a series of holes 154 therethrough, for receiving the upper ends of the mounting plates 88.

These parts, assembled as described above constitute the cage-like mounting assembly 70 for the print head 10. The print head 10 is then secured atop the printer carriage 11 in the desired position as shown in FIGS. 1 and 4 in any convenient fashion. In the embodiment illustrated, the upper surface of the carriage 11 is formed with flat mounting surfaces 160 for receiving portions of the under surfaces of the front and rear mounting plates 67 and 69, as shown in FIGS. 1 and 4. A rearwardly extending flange 161 of the rear mounting plate 69 is fastened to the carriage by a mounting screw 162, and the front plate 67 is mounted in place on the carriage 11 by a pair of spring arms 163 (FIG. 4) on the carriage 11 that engage flat surfaces 164 at either end of the front plate 67 to hold the unit in place on the carriage 11.

Review of Operation and Features

From the above description of a specific embodiment of the invention, it will be appreciated that a very simple and compact wire-matrix print head has been provided, involving relatively short, straight print wires 21–27 of progressively varying lengths and positioned essentially horizontally an essentially parallel throughout their lengths in the uniformly spaced and vertically stepped configuration described. With this arrangement, elaborate curved or tapered guides for the wires have been eliminated, with attendant simplification in construction of the printer and reduction in size. Each wire moves only a short distance in essentially a straight, horizontal printing line. In one typical example, the angle of convergence between the bottom wire 21 and the top wire 27 is only 1½°, thus the wires are essentially parallel throughout their lengths and all print wires are horizontal within three quarters on 1°.

By using the horizontally spaced and vertically stepped arrangement for the wires, the reeds 80 may correspondingly be horizontally spaced and verticaly stepped to permit arrangement in the simple and compact, interleaved array shown in FIGS. 1 and 4. The same is true with the arrrangement of the magnet cores 83 and supporting structure therefore, including the mounting plates 88. As will be apparent, this geometrical arrangement, and compact mounting assembly 70, renders feasible a very small and lightweight print head 10. In one typical example, the entire head assembly 10 is approximately 2.5 inches long (Y direction), 1.75 inches wide (X direction); by 2 inches high (Z direction) and weighs only ½ pound. Further, the thin, flat triangular C-shaped core 83 arrangement, with inwardly tapering side legs 90 defining the pole faces along flat inner surfaces thereof, permits viewing of the freshly printed characters shortly after printing, as well as providing closely spaced stacking of the actuators 71–77, thus contributing to small size and weight of the print head 10.

This small size and light-weight of the print head 10 also permits use of a relatively light and inexpensive carriage 11, as well as contributing to higher printing speed for a given drive motor 32. In one operating example, the head 10 can travel at a rate of over 280 individual dot columns *a–e* per second, which corresponds to a printing speed of about 400 words per minute, or around 300 words per minute throughput, including carriage-return and line-feed times.

Another significant feature that contributes to both small size and to high-speed and low-power operation is the arrangement of the electrical coils 103, magnet cores 83, and spring armature reeds 80, together with the electromagnetic operating pulse principles illustrated in FIGS. 13 and 14. With this arrangement, a single set of one latching and one release pulse 108 and 109 (FIG. 13B) is alternately applied to a single coil structure 103 to alternately magnetize and demagnetize the cores 83 according to the operating B-H curves in FIG. 14. This very rapidly latches, releases and relatches the companion reed 80, so as to cock, fire, and recock the print wires 21–27 in rapid succession as required for printing. With this arrangement, the total print cycle of cock, fire and recock can be performed in three milliseconds or less. The shape and geometry of the pole faces 91 and armature reed crossbar 93 provide a simple and rapid latching and firing mechanism, combining the best features of permanent magnets and electromagnets. The bevelled pole face constructioon permits sealing of the reeds 80 flat in the cocked position, while requiring zero power to latch and very low peak current requirements to fire and relatch, thus simplifying the driver circuitry and minimizing heat build-up.

In combination with the straight, generally parallel, horizontal print wire arrangement, the reed-to-print wire coupling 85 is advantageous in obtaining a short, virtually linear printing stroke from the flexing reeds 80. Also, the snap-on construction of the wire loop 62 on the plastic tip 86 of the reed 80 is advantageous in coupling the print wires 21–27 to the tips 84 of the spring reeds 80.

Further, the combination of a thin, flat T-shaped armature with a thin, flat C-shaped core is of importance in providing the compact and efficient actuator assembly, particularly in providing an array of closely spaced actuator assemblies which can be stacked as viewed in FIG. 4. Thus, the armature and core are mounted generally parallel to each other with the crossarm of the T facing and overlapping the air gap or space between the arms of the C.

As described in detail above, the specific mounting and pole geometry of the reed 80 and core 83 are very significant in the practice of the invention. In general, the capital letter designations T and C for these parts are intended to refer to the primary geometric features of these elements and their interrelationships. The small letter designation *t*, for the reed 80 refers to a generally cruciform piece shaped as a Latin cross, having a longer base leg or stem 80, which is fixed at its base, a crossarm such as 93 generally perpendicular to the stem, and an upper tip 84 to which a workpiece can be coupled for reciprocating movement on flexing of the reed.

While one preferred embodiment of the invention has been described in detail hereinabove, it will be apparent that various modifications may be made from the specific details described, and examples given without departing from the spirit and scope of the invention.

What is claimed is:

1. In a wire-matrix printer of the type including at least three reciprocable print wires, means for mounting inner printing ends of the wires, in a vertical column for movement toward and away from a printing station, and a plurality of individual actuators having portions connected to the outer ends of the print wires for reciprocating them to print characters, the improvement characterized by:

the print wires comprising substantially straight wires of uniformly varying length; and means for mounting the print wires essentially horizontally and parallel to each other in a vertical column throughout their lengths, for substantially linear reciprocation along spaced, parallel, essentially horizontal printing axes, and so that the lowermost wire in the column is the shortest and each successive higher wire in the column is a predetermined amount longer than the preceding one, whereby the outer ends of the print wires define a horizontally spaced and vertically stepped array.

2. A printer as recited in claim 1, wherein the print wire mounting means includes:

a plurality of spring reeds corresponding one to each print wire;

means for mounting the spring reeds generally vertically in a parallel row such that the lower end of each reed is fixed and the upper end is free to flex and is aligned with the outer end of the corresponding print wire; and means for coupling the outer end of each print wire to the upper end of the corresponding reed.

3. A printer as recited in claim 2, wherein the coupling means includes:

a plastic insert mounted on the upper end of each reed; and a wire loop formed at the outer end of each print wire and flexibly coupled about the plastic insert so that the print wire reciprocates essentially horizontally in response to flexing movement of the reed.

4. A printer as recited in claim 3, wherein the wire loop comprises an expansion spring shaped to resiliently grip portions of the perimeter of the plastic insert to couple the print wire to the reed.

5. A printer as recited in claim 4, wherein:

each plastic insert comprises a plastic tip attached to the upper end of its corresponding reed, the tip having inner and outer flat faces facing toward and away from the printing station, respectively, the outer tip face being formed with a horizontal groove perpendicular to both the corresponding print wire and reed, the loop being of such size that a first portion of the loop is received in the groove and a second portion of the loop opposed to the first loop portion fits over the tip and expands the loop thereby to resiliently grip the inner face of the tip with the loop.

6. A printer as recited in claim 5, wherein the tip is formed with an inclined camming surface at the top of the front face which forces the second portion of the loop outward and, with the loop placed over the tip, into resilient gripping engagement with the inner face, so that the print wire and reed are assembled with a snap-on fit.

7. A printer as recited in claim 3, wherein the plastic insert is formed with a central longitudinal groove in the upper surface thereof running in the same direction as and parallel to the print wires, a section of the body of the next higher print wire being received in the longitudinal groove above the upper end of every reed except the uppermost one each received print wire being out of contact with the reed and insert corresponding to the next lower print wire.

8. A printer as recited in claim 3, wherein each spring reed comprises a Latin cross, *t*-shaped member having the plastic insert affixed to the top of the *t*, above the crossarm, and the wire is coupled about the insert above the crossarm.

9. A printer as recited in claim 8, wherein:

the insert has a generally rectangular perimeter about the top of the *t*; and the wire loop has a generally elliptical configuration with inner and outer straight side legs shaped to fit the contours of the insert with an expansionspring fit.

10. A printer as recited in claim 9, wherein each insert comprises a plastic tip molded about the upper end of its corresponding reed above the crossarm, each tip having the first groove for receiving and locating a portion of its corresponding wire loop, and a second groove for receiving a portion of the next higher print wire out of contact with the tip.

11. A printer as recited in claim 1, wherein the print wire mounting means includes:

a plurality of spring reeds corresponding one to each print wire, each reed comprising a Latin cross, *t*-shaped member of such material and thickness that the body of the reed comprises a leaf spring;

means for mounting the reeds generally vertically in a parallel row so that the base of the *t* is down and is fixed at its lower end, so that the tip of the *t* above the crossarm is free to flex toward and away from the printing station and is aligned with the outer end of the corresponding print wire, and so that the crossarm of the *t* is generally horizontal and generally perpendicular to the plane of the vertical print wire column; and means for coupling the outer end of each print wire to the tip of the corresponding reed.

12. A printer as recited in claim 11, wherein the reeds comprise identical members, and the reed mounting means is arranged to mount the reeds in a horizontally spaced and vertically stepped array corresponding to that defined by the outer ends of the print wires.

13. A printer as recited in claim 11, wherein the actuators include:

means for biasing the crossarm of each reed away from the printing station to hold the reed in a cocked position, in which the reed body is bowed to store potential energy; and means for releasing the bias applied to any given reed when it is desired to print a dot with its companion print wire, the reeds being so constructed and mounted that the cocked spring body of the reed then takes over and fires the associated print wire toward the printing station to print a dot.

14. A printer as recited in claim 13, wherein:

the biasing means comprises a plurality of magnetic means, one to each reed, for attracting the crossarm of a corresponding reed and magnetically latching it in the cocked position, the reeds being made of ferromagnetic material so as to constitute magnet armatures; and the means for releasing comprises a plurality of means one to each biasing means for individually demagnetizing its corresponding magnetic means to a sufficient degree where its corresponding magnetic means no longer is capable of holding the associated reed in the latched position.

15. A printer as recited in claim 14, wherein each magnetic means is so constructed and arranged that it acts as an electromagnet when attracting the associated reed into the latched position and as a permanent magnet when holding the reed in the latched position.

16. A printer as recited in claim 14, where each magnetic means includes:

a magnet core mounted parallel to its corresponding reed on the opposite side of such reed from the corresponding print wire, each core having spaced pole faces aligned with the ends of the crossarm of its corresponding reed; and electrical circuit means for magnetizing and demagnetizing the core.

17. A printer as recited in claim 16, wherein:

the reeds comprise identical members and the cores comprise identical members;

means are provided for fastening the reeds and cores together into individual subassemblies each consisting of one core and one reed; and means are provided for mounting the core-reed subassemblies in a parallel, horizontally spaced and vertically stepped array corresponding to the pattern defined by the outer ends of the print wires so that the tips of the successive reeds in the array are aligned with the outer ends of the corresponding print wires.

18. A printer as recited in claim 14, wherein:

the reeds comprise relatively thin, flat plates and the stems of the reeds taper inwardly from the base of each reed to the crossarm, with the narrowest portion of the stem being located just below the crossarm.

19. A printer as recited in claim 14, wherein:

the reed mounting means are so arranged that, in a neutral unattracted condition, the reeds incline forward from base to tip toward the printing station at an angle $\theta$ from the vertical.

20. A printer as recited in claim 19, wherein the magnetic means are so arranged and the angle $\theta$ is so set that, when magnetically attracted, each reed flexes rearward away from the printing station and past the vertical so that the crossarm is inclined from the vertical at an angle $\phi$ when latched, with the reed stem bowed in a retroflex curve.

21. A printer as recited in claim 20 wherein the angle $\theta$ is set approximately equal to the angle $\phi$, the combination of the angles $\theta$ and $\phi$ determining the amount of the potential energy storable in each cocked spring reed, given a particular reed material and geometry.

22. A printer as recited in claim 20, wherein the magnetic means include pairs of spaced pole faces, one pair to each reed, mounted on the opposite side of the reed from the companion print wire, the pole faces in each pair being aligned with opposed areas at the ends of the crossarm of the associated reed, the pole faces being bevelled away from the reed and the printing station at the angle $\phi$ set in accordance with the reed geometry so that the opposed crossarm areas at the ends thereof lie flat against the bevelled surfaces of the pole faces to magnetically seal the reed crossarm against the pole faces with the crossarm closing the gap between the pole faces.

23. A printer as recited in claim 14, wherein:

the magnetic means includes pairs of spaced pole faces, one pair to each reed, mounted on the opposite side of the reed from the companion print wire, the pole faces in each pair being aligned with opposed areas at the ends of the crossarm of the associated reed;

the reed mounting means are so arranged that, when magnetically attracted, each reed body flexes rearward away from the printing station and the crossarm is inclined at an angle $\phi$ from the vertical; and the pole faces are bevelled away from the reed and the printing station at the angle $\phi$ set in accordance with the reed geometry so that the opposed crossarm areas at the ends thereof lie flat against the bevelled surfaces of the pole faces to magnetically seal the reed crossarm against the pole faces with the crossarm closing the gap between the pole faces.

24. A printer as recited in claim 1

I. wherein the mounting means for the print wires include: a plurality of magnet armatures corresponding one to each print wire;

means for mounting the armatures so that portions thereof are movable toward and away from the printing station and portions thereof are aligned with the outer end of the corresponding print wire; and means for coupling the outer end of each print wire to the aligned portion of the corresponding armature and II. wherein the actuators include:

the armatures;

a plurality of magnet cores corresponding one to each armature, each core having a pair of spaced pole faces;

means for mounting each magnet core adjacent to its companion armature on the opposite side from the associated print wire and the printing station so that the pole faces are aligned with portions of the corresponding armature;

means for selectively magnetizing and demagnetizing each core so that (1) when the core is magnetized, it attracts the armature against the pole faces to bias the armature and the corresponding print wire to a retracted position with respect to the printing station, and (2) when the core is demagnetized, the armature is magnetically released; and means for driving the armature and associated print wire forward toward the printing station to print a dot when the core is demagnetized.

25. A printer as recited in claim 24, wherein the cores comprise identical members, and the core-mounting means are arranged to mount the cores with the pole faces located in a horizontally spaced and vertically stepped array corresponding to the pattern defined by the outer ends of the print wires.

26. A printer as recited in claim 25, wherein the cores comprise relatively thin, generally flat plates mounted in spaced, parallel vertical planes and vertically stepped from each other, the pole faces being disposed at spaced areas along inner, generally flat surfaces of the cores.

27. A printer as recited in claim 26, wherein each core has a base portion and a pair of arms extending toward each other from the base portion so as to define an air gap in the space between the inner tips of the arms, areas of the arms adjacent to the inner tips constituting the pole faces of the core.

28. A printer as recited in claim 27, wherein:

the armatures comprise flat spring reeds;

the armature mounting means are arranged for mounting the reeds generally vertically and, generally parallel to the associated core so that one end is fixed and the other end is free to flex toward and away from the printing station and the associated core, the armature reed having portions aligned with and overlapping the pole faces of the core so that these portions are attracted to and magnetically latched against the pole faces when the core is magnetized, the reed being further mounted so that the body of the reed bows rearward when the reed is latched to cock the reed in the retracted position; and the driving means comprises the cocked spring reed body, which stores sufficient potential energy in the cocked position to drive the associated print wire against the printing station.

29. A printer as recited in claim 28, wherein the reed-mounting means comprises means for fastening each reed to the base portion of the associated core so that the overlapping armature portions of the reed are normally spaced from the pole faces by a preset distance when the associated core is in a neutral, nonmagnetized state.

30. A printer as recited in claim 29, wherein:

the reed fastening means are so arranged that, in the neutral, nonmagnetized state, the reeds incline forward from base to tip toward the printing station at an angle $\theta$ from the vertical.

31. A printer as recited in claim 30, wherein the cores are so arranged that, when magnetically attracted, each reed flexes rearward past the vertical and the reed is inclined from the vertical at a reverse angle $\phi$ when latched, with the reed body bowed in a retroflex curve.

32. A printer as recited in claim 31, wherein the angle $\theta$ is set approximately equal to the angle $\phi$ , the combination of the angles $\theta$ and $\phi$ setting the amount of potential energy storable in each cocked spring reed, given a particular reed material and geometry.

33. A printer as recited in claim 31, wherein the pole faces of the core are bevelled away from the reed and the printing station at the angle $\phi$ set in accordance with the reed geometry so that the facing areas at the tips of the crossarms lie flat against the bevelled surfaces of the pole faces to magnetically seal the reed against the pole faces with portions of the reed closing the gap between the pole faces.

34. A printer as recited in claim 24, wherein each core comprises a symmetrical generally triangular C-shaped member having a base leg and a pair of arms sloping inwardly toward each other from the base leg and spaced from each other to define an air gap in the space between the inner tips of the arms, the pole faces of the core being defined by areas of the core adjacent to the inner tips of the arms.

35. A printer as recited in claim 34, wherein the core is shaped so that the pole face areas face the armature and are generally trianglular.

36. A printer as recited in claim 35, wherein the triangular pole face areas are so disposed that corresponding vertices of each triangle are located at the inner facing tips of the arms, so that the air gap is defined between facing angles of the arms.

37. A printer as recited in claim 36, wherein the facing angles are identical obtuse angles.

38. A printer as recited in claim 35, wherein:

the armature comprises a flat spring reed fixed at one end and having a free end mounted for flexing movement toward and away from the pole faces, the reed having opposed areas respectively aligned with and overlapping the pole faces; and the pole faces are bevelled away from the reed and the printing station at angles so that the opposed portions of the reed in the attracted position lie flat against the pole faces and are magnetically sealed thereagainst.

39. A printer as recited in claim 38, wherein: the cores comprise relatively thin, flat plates wherein the core mounting means positions the cores in parallel vertical planes adjacent to the reeds, with the base leg of the C horizontal and with the legs tapering upwardly toward the top and the air gap centered over the middle of the base leg and horizontally aligned with the center of the reed, the cores and the reeds being horizontally spaced and vertically stepped in accordance with the pattern of the outer ends of the print wires.

40. A printer as recited in claim 39, wherein the reed mounting means includes means for fixing a lower end of each reed to an area at the center of the base leg of the corresponding core, the working length of the reed and thus the resultant spring force being a function of the length of the base leg of the core and the angle of inclination of the arms of the core, which set the vertical altitude between the reed armature portions and the point of affixation of the reed to the base leg of the core.

41. A printer as recited in claim 40, wherein the surface of the base leg of the core against which the reed is mounted is bevelled downward and away from the printing station at an angle $\theta$ set so that the reed projects forward toward the printing station at the angle $\theta$ when the core is not magnetized, the spacing between reed armature portions and pole faces when the core is non-magnetized being set by the angle $\theta$ and the length of the reed from the mounting point to the pole faces.

42. A printer as recited in claim 41, wherein $\theta$ is set approximately equal to $\phi$, the combination of the angles $\theta$ and $\phi$ with the reed length and material, setting the amount of potential energy storable in the cocked spring.

43. A printer as recited in claim 34, wherein:

the core arms have equal rectangular cross sections; and the means for magnetizing and demagnetizing each core include electrical circuit means having a pair of electrical windings, one winding being positioned on each core arm between the pole face and the base leg of the C.

44. A printer as recited in claim 43, wherein:

the windings are prewound on plastic bobbins having rectangular mounting holes shaped to fit over the tips of the core arms the core arms being formed with enlarged shoulders near the bases of the arms for receiving the bobbins.

45. A printer as recited in claim 44, wherein the circuit means further include plastic inserts shaped to fit along a side wall of each core at the base of each arm and having electrical connector plugs for the windings projecting downward beneath the base leg of the core, and a printed circuit board fastened to the printer below the cores and receiving the connector plugs for connecting the windings to control circuits for operating the printer.

46. A printer as recited in claim 24, wherein the means for selectively magnetizing and demagnetizing each core includes electrical circuit means arranged to:

1. magnetize the core so as to latch the armature in the rearward position prior to a first printing operation;
2. demagnetize the core to actuate the means for driving the armature and print wire to print each required dot; and then
3. promptly remagnetize the core so as to relatch the armature on rebound.

47. A printer as recited in claim 46, wherein the core and circuit means are so constructed and arranged that an electrical pulse in a first or forward direction magnetizes the core sufficiently to attract and magnetically latch the armature against the core, and that a momentary electrical pulse in the opposite or reverse direction demagnetizes the core sufficiently to release the armature.

48. A printer as recited in claim 47, wherein the driving means includes a spring tensioned on latching of the armature and released on partial demagnetization of the core to fire the print wire toward the printing station.

49. A printer as recited in claim 48, wherein the electrical circuit means are so arranged that the forward pulse is stronger than the reverse pulse and so that the core is not driven to magnetic zero, below the H axis of the operating magnetic B–H curve for the core material, by the reverse pulse.

50. A printer as recited in claim 49, wherein the core and pulsing means are so arranged that the core acts as an electromagnet when attracting the armature into the latched position and as a permanent magnet when holding the reed in the latched position.

51. A printer as recited in claim 50, wherein each core has an operating magnetic B–H curve as illustrated in FIG. 14 of the drawings.

52. A printer as recited in claim 1;

I. wherein the mounting means for the print wires include a plurality of magnet armatures corresponding one to each print wire, each armature comprising a flat spring reed;

means for mounting the reeds generally vertically in a parallel row so that a lower end of each reed is fixed and an upper end thereof is free to flex toward and away from the printing station and portions thereof are aligned with outer ends of the corresponding print wire; and means for coupling the outer end of each print wire to the aligned portion of the corresponding reed; and II. wherein the actuators include:

the reeds;

a plurality of magnet cores corresponding one to each reed, each core comprising a flat plate having a pair of core arms extending toward each other from a base portion so as to define an air gap between the inner tips of the arms, areas of the arms adjacent to the inner tips constituting spaced pole faces of the core;

means for mounting the magnet cores generally vertically adjacent to the companion reeds on the opposite side from the associated print wire and the printing station so that the pole faces are aligned with facing portions of the corresponding reeds; and means for selectively magnetizing and demagnetizing each core so that (1) when the core is magnetized, it attracts the facing portions of the reed against the pole faces to cock the reed in a retracted position with respect to the printing station, and (2) when the core is demagnetized, the reed is magnetically released so that the cocked spring reed drives the associated print wire forward toward the printing station to print a dot.

53. A printer as recited in claim 52, wherein the progressive variation in print-wire length is a given amount greater than the combined thicknesses of the reed and the core.

54. A printer as recited in claim 53, wherein the mounting means for the reeds and cores include means for mounting each pair of reeds and cores in a horizontally spaced and veritcally stepped print head assembly corresponding to the spaced and vertically stepped array of the outer ends of the print wires.

55. A printer as recited in claim 54, wherein the mounting means for the reeds and cores further include:

a plurality of actuator mounting panels associated one with each core and reed pair;

means for mounting each core to its companion panel so that the panel, core and reed form a discrete actuator subassembly for the associated print wire; and means ford assembling the mounting panels together to form a print head assembly.

56. A printer as recited in claim 55, wherein:

the mounting panels, cores and reeds all comprise identical members in each actuator subassembly, and the panel-assembling means is arranged to mount the panels in the horizontally spaced and vertically stepped array corresponding to that defined by the inner ends of the print wires so that the panel positions set the corresponding positions of the cores, reeds, and the outer ends of the associated print wires coupled to the reeds.

57. A printer as recited in claim 56, wherein each panel is formed with a slotted extension at its upper-end for receiving and guiding the print wires coupled to all higher subassemblies in the array.

58. A printer as recited in claim 57, wherein the mounting panels comprise flat blocks having a thickness equal to the desired horizontal increment of length between consecutive print wires, the blocks having mounting recesses for receiving the associated core and reed, and the blocks being assembled in a stacked vertical, parallel array with each block contacting the block associated with adjacent print wires.

59. A printer as recited in claim 58, further comprising front and rear print head mounting panels, also comprising flat blocks, the front-head mounting panel being assembled in contacting engagement with the first actuator-mounting panel in the array (for the lowermost wire) and the rear head-mounting panel being assembled in contacting engagement with the last actuator-mounting panel (for the uppermost wire); and means for fastening the front and rear head-mounting panels together with the actuator-mounting panels into a rigid, cage-like mounting assembly for the print wires and actuator members.

60. A printer as recited in claim 59, wherein the front head-mounting panel is formed with an upwardly extending slotted guide for guiding all of the print wires to the printing station.

61. A printer as recited in claim 60, further comprising a cover plate secured atop the front and rear head-mounting panels and covering the array of print wires.

62. A printer as recited in claim 59, further comprising a printed circuit board secured to the bottom surfaces of the front and rear head-mounting panels, and carrying electrical circuit means for magnetizing and demagnetizing the cores.

63. A printer as recited in claim 62, further comprising:

a reciprocable carriage for the print head; and means for mounting the front and rear head-mounting panels to the carriage to position the print head on the carriage and with respect to the printing station.

64. A printer as recited in claim 59, wherein the actuator-mounting panels comprise identical pieces having locating holes on one side and mounting pins on the other arranged to mount the panels together in the stacked assembly and to set the required position of each panel with respect to the next, thus setting the height of each print wire in the array, and wherein the front and rear head-mounting panels have similar locating and mounting means to set the position of the first and last actuator-mounting panels with respect to the front and rear head-mounting panels.

65. A printer as recited in claim 59, wherein the fastening means comprises:

a fastening band threaded through mounting holes in all of the panels;

a spring for urging one end of the band against one of the front and rear mounting plates so as to urge the panels together; and retainer means for holding the band in place against the assembly.

66. A printer as recited in claim 65, wherein the band comprises a square U-shaped metal band having outwardly curved tips at the ends of the U.

67. A printer as recited in claim 66, wherein the keeper means comprises a retainer plate positioned against the front panel and having receiving holes for receiving and retaining the outer tips of the band.

68. A printer as recited in claim 67, wherein the band-urging spring comprises a bowed flat spring keeper plate having outer tips received against spaced contact points along the outer surface of the rear head-mounting panel, and having a bowed central section spaced from the rear head-mounting panel and engaging the base of the band so as to urge the band longitudinally rearward of the head mounting panels to urge the tips of the band into the retaining holes in the retainer plate.

69. The printer as recited in claim 54, wherein in each actuator;

each reed comprises a *t*-shaped flat plate fabricated of a ferromagnetic spring metal;

each core comprises a rectangular C-shaped, flat metal plate fabricated of a magnetizable, highly retentive metal; and each pair of reeds and cores are of such relative sizes and are so mounted with respect to each other that the gap between the arms of the C aligns with the crossarm of the *t* and areas at the ends of the crossarm of the *t* overlap facing portions of the ends of the core arms, the overlapping areas of the core arms comprising the pole faces of the core.

70. Apparatus for coupling an outer end of a reciprocable wire to an actuator, the wire having an inner working end positioned adjacent to a work station, which comprises:

a spring reed for actuating the wire;

means for mounting the spring reed generally perpendicular to the wire in a position such that one end of the reed is fixed and the other end is free to flex and is aligned with the outer end of the wire;

a plastic insert mounted on the free end of the reed; and a wire loop formed at the outer end of the wire and flexibly coupled about the plastic insert so that the wire reciprocates essentially linearly along a work axis in response to flexing movement of the reed.

71. Apparatus as recited in claim 70, wherein the wire loop comprises an expansion spring shaped to resiliently grip portions of the perimeter of the plastic insert to couple the wire to the reed.

72. Apparatus as recited in claim 71, wherein:

the plastic insert comprises a plastic tip attached to the free end of the reed, the tip having inner and outer flat faces facing toward and away from the work station, respectively, the outer tip face being formed with a horizontal groove perpendicular to both the wire and the reed, the loop being of such size that a first portion of the loop is received in the groove and a second portion of the loop opposed to the first loop portion fits over the tip and expands the loop thereby to resiliently grip the inner face of the tip with the loop.

73. Apparatus as recited in claim 72, wherein the tip is formed with an inclined camming surface at the top of the front face which forces the second portion of the loop outward and, with the loop placed over the tip, into resilient gripping engagement with the inner face, so that the wire and reed are assembled with a snap-on fit.

74. Apparatus as recited in claim 70, wherein the spring reed comprises a Latin cross,*t*-shaped member having the plastic insert affixed to the top of the *t*, above the crossarm, and the wire is coupled about the insert above the crossarm.

75. Apparatus as recited in claim 74, wherein:

the insert has a generally rectangular perimeter about the top of the *t*; and the wire loop has a generally elliptical configuration with inner and outer straight side legs shaped to fit the contours of the insert with an expansion-spring fit.

76. Apparatus as recited in claim 75, wherein the insert comprises a plastic tip molded about the upper end of the reed above the crossarm, the tip having a groove for receiving and locating a portion of the wire loop so that the wire loop fits on the tip with a snap-on fit.

77. Apparatus for moving a workpiece toward and away from a work station, which comprises:

a spring reed comprising a Latin cross, *t*-shaped member of such material and thickness that the body of the reed comprises a leaf spring;

means for mounting the reed so that the base of the *t* is fixed, the tip of the *t* above the crossarm is free to flex toward and away from the work station, and the crossarm of the *t* faces the work station and extends in a direction generally perpendicular to the line of flexing of the reed;

means for mounting the workpiece to the tip of the reed so that the workpiece moves toward and away from the work station on flexing movement of the reed;

means for biasing the crossarm of the reed away from the work station to hold the reed in a cocked position, in which the reed body is bowed to store potential energy therein; and means for releasing the bias when it is desired to actuate the workpiece, the reed being so constructed and mounted that the bowed spring body of the reed then takes over and drives the workpiece toward the work station.

78. Apparatus as recited in claim 77, wherein: the biasing means comprises magnetic means for attracting the crossarm of the reed and magnetically latching it in the cocked position, the reed being made of ferromagnetic material so as to constitute a magnet armature; and the means for releasing comprises means for demagnetizing the magnetic means to a sufficient degree where it no longer is capable of holding the associated reed in the latched position.

79. Apparatus as recited in claim 77, wherein the magnetic means is so constructed and arranged that it acts as an electromagnet when attracting the reed into the latched position and as a permanent magnet when holding the reed in the latched position.

80. Apparatus as recited in claim 77, wherein the magnetic means includes:

a magnet core mounted parallel to the reed on the opposite side of the reed from the work station and having spaced pole faces aligned with the ends of the crossarm of the reed; and electrical circuit means for magnetizing and demagnetizing the core.

81. Apparatus as recited in claim 78, wherein:

the reed comprises a relatively thin, flat plate; and the stem of the reed tapers inwardly from the base of the reed to the crossarm, with the narrowest portion of the stem being located just below the crossarm, to minimize stress in the reed.

82. Apparatus as recited in claim 32, wherein: the reed mounting means is so arranged that, in a neutral, unattracted condition, the reed inclines forward from the base to tip toward the work station at an angle $\theta$ from a reference plane perpendicular to the line of movement of the tip of the reed.

83. Apparatus as recited in claim 82, wherein the magnetic means is so arranged and the angle $\theta$ is so set that, when magnetically attracted, the reed flexes rearward away from the work station and past the reference plane so that the crossarm is inclined from the reference plane at an angle $\phi$ when latched, with the reed stem bowed in a retroflex curve.

84. Apparatus as recited in claim 83, wherein the angle $\theta$ is set approximately equal to the angle $\phi$, the combination of the angles $\theta$ and $\phi$ determining the amount of potential energy storable in the cocked spring reed, given a particular reed material and geometry.

85. Apparatus as recited in claim 83, wherein the magnetic means includes a pair of spaced pole faces mounted on the opposite side of the reed from the work station and aligned with opposed areas at the ends of the crossarms of the reed, the pole faces being bevelled away from the reed and the work station at the angle $\phi$ set in accordance with the reed geometry so that the opposed crossarm areas at the ends thereof lie flat against the bevelled surfaces of the pole faces to magnetically seal the reed crossarm against the pole faces with the crossarm closing the gap between the pole faces.

86. Apparatus as recited in claim 78, wherein:

the magnetic means includes a pair of spaced pole faces mounted on the opposite side of the reed from the work station and aligned with opposed areas at the ends of the crossarm of the reed;

the reed mounting means is so arranged that, when magnetically attracted, the reed body flexes away from the work station and the crossarm is inclined at an angle $\phi$ from a reference plane perpendicular to the line of movement of the tip of the reed; and the pole faces are bevelled away from the reed and the work station at the angle $\phi$, set in accordance with the reed geometry so that the opposed crossarm areas at the ends thereof lie flat against the bevelled surfaces of the pole faces to magnetically seal the reed crossarm against the pole faces with the crossarm closing the gap between the pole faces.

87. An electromagnetic actuator, which comprises:

a magnet armature;

means for mounting the armature so that portions thereof are movable toward and away from a work station along a line Y;

a magnet core comprising a generally flat plate having a base portion and a pair of arms extending toward each other from the base portion so as to define an air gap in the space between the inner tips of the arms, areas of the arms adjacent to the inner tips constituting spaced pole faces of the core;

means for mounting the magnet core adjacent to the armature on the opposite side from the work station so that the core is generaly perpendicular to the line Y and an inner, generally flat surface of the core plate faces the armature and work station, the pole faces being aligned with portions of the armature and being disposed at spaced areas along the inner surface of the core;

means for selectively magnetizing and demagnetizing the core so that (1) when the core is magnetized, it attracts the armature against the pole faces to bias the armature to a retracted position, away from the work station, and (2) when the core is demagnetized, the armature is magnetically released; and means for driving the armature forward toward the work station when the core is demagnetized.

88. Apparatus as recited in claim 87, wherein:

the armature comprises a flat spring reed;

the armature mounting means is arranged for mounting the reed generally parallel to the core so that one end is fixed and the other end is free to flex toward and away from the work station and the core, the armature reed having portions aligned with and overlapping the pole faces of the core so that these portions are attracted to and magnetically latched against the pole faces when the core is magnetized, the reed being further mounted so that the body of the reed bows rearward, away from the work station, when the reed is latched to cock the reed in the retracted position; and the driving means comprises the cocked spring reed body, which stores sufficient potential energy in the cocked position to drive the free end of the reed toward the work station.

89. Apparatus as recited in claim 88, wherein the reed-mounting means comprises means for fastening the reed to the base portion of the core so that the overlapping armature portions of the reed are normally spaced from the pole faces by a preset distance when the associated core is in a neutral, magnetized state.

90. Apparatus as recited in claim 88, wherein:

the reed fastening means is so arrannged that, in the neutral, nonmagnetized state, the reed inclines forward from base to tip toward the work station at an angle $\theta$ from a reference plane parallel to the core.

91. Apparatus as recited in claim 89, wherein the core is so arranged that, when magnetically attracted, the reed flexes rearward, away from the work station, past the reference plane and is inclined from the reference plane at a reverse angle $\phi$ when latched, with the reed body bowed in a retroflex curve.

92. Apparatus as recited in claim 91, wherein the angle $\theta$ is set approximately equal to the angle $\phi$, the combination of the angles $\theta$ and $\phi$ setting the power available from the cocked spring reed on release, given a particular reed material and geometry.

93. Apparatus as recited in claim 91, wherein the pole faces of the core are bevelled away from the reed at the angle $\phi$, set in accordance with the reed geometry so that the facing areas of the reeds lie flat against the bevelled surfaces of the pole faces, to magnetically seal the reed against the pole faces with portions of the reed closing the gap between the pole faces.

94. Apparatus as recited in claim 87, wherein the core comprises a symmetrical, generally triangular C-shaped plate in which the arms of the C slope inwardly toward each other from the base leg to define the air gap in the space between the inner tips of the arms, and the pole faces are defined at areas adjacent to the inner tips of the arms.

95. Apparatus as recited in claim 94, wherein the core is shaped so that the pole face areas are generally triangular as viewed in a plane looking from the armature toward the core.

96. Apparatus as recited in claim 95, wherein the triangular pole face areas are so disposed that corresponding vertices of each triangle are located at the inner facing tips of the arms, so that the air gap is defined between the facing vertices of the arms.

97. Apparatus as recited in claim 96, wherein the facing vertices comprise identical obtuse angles.

98. Apparatus as recited in claim 94 wherein:

the armature comprises a flat spring reed fixed at one end and having a free end mounted for flexing movement toward and away from the pole faces, the reed having facing areas aligned with and overlapping the pole faces; and the pole faces are bevelled away from the reed at angles so that the facing portions of the reed in the attracted position lie flat against the pole faces and are magnetically sealed thereagainst.

99. Apparatus as recited in claim 98, wherein the reed mounting means includes means for fixing one end of the reed to an area at the center of the base leg of the core, the working length of the reed and thus the resultant spring force being a function of the length of the base leg of the core and the angle of inclination of the arms of the core, which set the altitude between the reed-latching portions and the point of affixation of the reed to the base leg of the core.

100. Apparatus as recited in claim 99, wherein the surface of the base leg of the core against which the reed is mounted is bevelled at an angle $\theta$ set so that the reed projects forward toward the work station at the angle $\theta$ when the core is not magnetized, the neutral spacing between reed armature portions and pole faces being set by the angle $\theta$ and the length of the reed from mounting point to the pole faces.

101. Apparatus as recited in claim 100 wherein, on latching, the reed flexes rearwardly to a reverse angle $\phi$, $\theta$ being set approximately equal to $\phi$, the combination of the angles $\theta$ and $\phi$, with the reed length and material, setting the power available from the cocked spring upon release.

102. Apparatus as recited in claim 94, wherein:

the core arms have equal rectangular cross sections; and the means for magnetizing and demagnetizing the core includes electrical circuit means having a pair of electrical windings, one positioned on each core arm between the pole face and the base leg of the C.

103. Apparatus as recited in claim 102, wherein:

the windings are prewound on plastic bobbins having rectangular mounting holes shaped to fit over the tips of the core arms, the core arms being formed with enlarged shoulders near the bases of the arms for receiving the bobbins.

104. Apparatus as recited in claim 87, wherein the means for selectively magnetizing and demagnetizing the core includes electrical circuit means arranged to:

1. magnetize the core so as to latch the armature in the rearward position prior to a first work operation;
2. demagnetize the core to actuate the means for driving the armature to accomplish a work operation; and then
3. promptly remagnetize the core so as to relatch the armature after the work operation.

105. Apparatus as recited in claim 104, wherein the core and circuit means are so constructed and arranged that an electrical pulse in a first or "forward" direction magnetizes the core sufficiently to attract and magnetically latch the armature against the core, and that a momentary electrical pulse in the opposite or "reverse" direction demagnetizes the core sufficiently to release the armature.

106. Apparatus as recited in claim 105, wherein the driving means includes a spring tensioned on latching of the armature and released on partial demagnetization of the core to fire the armature toward the work station.

107. Apparatus as recited in claim 106, wherein the electrical pulsing means are so arranged that the forward pulse is stronger than the reverse pulse and so that the core is not driven to magnetic zero (below the H axis of the operating magnetic B–H curve for the core material) by the reverse pulse.

108. Apparatus as recited in claim 107, wherein the core and pulsing means are so arranged that the core acts as an electromagnet when attracting the armature into the latched position and as a permanent magnet when holding the reed in the latched position.

109. Apparatus as recited in claim 108, wherein the core has an operating magnetic B–H curve as illustrated in FIG. 14 of the drawings.

110. An assembly of electromagnetic actuators for independently moving selected ones of a plurality of associated workpieces toward and away from a work station, which comprises:

a plurality of magnet armatures corresponding one to each workpiece, each armature comprising a flat spring reed;

means for mounting the reeds in a paralled row so that one end of each reed is fixed and the other end thereof is free to flex toward and away from the work station and portions thereof are aligned with portions of the corresponding workpiece;

means for coupling a portion of each workpiece to the aligned portion of the corresponding reed;

a plurality of magnet cores corresponding one to each reed, each core comprising a flat plate having a pair of core arms extending toward each other from a base portion so as to define an air gap between the inner tips of the arms, areas of the arms adjacent to the inner tips constituting spaced pole faces of the core;

means for mounting the magnet cores generally parallel to the companion reeds on the opposite side from the associated workpiece so that the pole faces are aligned with facing portions of the corresponding reeds; and means for selectively magnetizing and demagnetizing each core so that (1) when the core is magnetized, it attracts the facing portions of the reed against the pole faces to cock the reed in a retracted position with respect to the work station, and (2) when the core is demagnetized, the reed is magnetically released so that the cocked spring reed drives the associated workpiece forward toward the work station.

111. Apparatus as recited in claim 110, wherein:

the coupled portions of the workpieces are located different distances from the work station, and are located at different levels with respect to each other so as to define a progressively spaced and stepped array with respect to the work station; and the mounting means for the reeds and cores include means for mounting each pair of reeds and cores in a spaced and stepped assembly corresponding to the spaced and stepped array of the coupled portions of the workpieces.

112. Apparatus as recited in claim 111, wherein the mounting means for the reeds and cores further include:

a plurality of actuator mounting panels associated one with each core and reed pair;

means for mounting each core to its companion panel so that the panel, core and reed form a discrete actuator subassembly for the associated workpiece; and means for assembling the mounting panels together to form a unitary, operating assembly of the actuators and workpieces.

113. Apparatus as recited in claim 112, wherein:

the mounting panels, cores and reeds all comprise identical members in each actuator subassembly, and the panel-assembly means is arranged to mount the panels in the spaced and stepped array corresponding to that defined by the workpieces so that the panel positions set the corresponding positions of the cores, reeds, and the coupled portions of the associated workpieces.

114. Apparatus as recited in claim 113, wherein the mounting panels comprise flat blocks having a thickness equal to the desired increment of length between consecutive workpieces, the blocks having mounting recesses for receiving the associated core and reed, and the blocks being assembled in a stepped, parallel array with each block contacting the one associated with adjacent workpieces.

115. Apparatus as recited in claim 114, further comprising front and rear assembly-mounting panels, also comprising flat blocks, the front assembly-mounting panel being assembled in contacting engagement with a first actuator-mounting panel in the array and the rear assembly-mounting panel being assembled in contacting engagement with the last actuator-mounting panel; and means for fastening the front and rear assembly-mounting panels together with the actuator-mounting panels into a rigid, cage-like mounting assembly for the array of actuators and workpieces.

116. Apparatus as recited in claim 115, wherein the actuator-mounting panels comprise identical pieces having locating holes on one side and mounting pins on the other arranged to mount the panels together in a stacked assembly and to set the required position of each panel with respect to the next, and wherein the front and rear assembly-mounting panels have similar locating and mounting means to set the position of the first and last actuator-mounting panels with respect to the front and rear assembly-mounting panels, so as to set the position of each workpiece in the array.

117. Apparatus as recited in claim 115, wherein the fastening means comprises:

a fastening band threaded through mounting holes in all of the panels;

a spring for urging one end of the band against one of the front and rear mounting plates so as to urge the panels together; and retainer means for holding the band in place against the assembly.

118. Apparatus as recited in claim 117, wherein the band comprises a square U-shaped metal band having outwardly curved tips at the ends of the U.

119. Apparatus as recited in claim 118, wherein the keeper means comprises a retainer plate positioned against the front panel and having receiving holes for receiving and retaining the outer tips of the band.

120. Apparatus as recited in claim 119, wherein the band-urging spring comprises a bowed flat spring keeper plate having outer tips received against spaced contact points along the outer surface of the rear assembly-mounting panel, and having a bowed central section spaced from the rear mounting panel and engaging the base of the band so as to urge the band longitudinally rearward of the assembly-mounting panels to urge the tips of the band into the retaining holes in the retainer plate.

121. Apparatus as recited in claim 110, wherein:

each reed comprises a *t*-shaped, flat plate fabricated of a ferromagnetic spring metal;

each core comprises a rectangular C-shaped, flat plate fabricated of a magnetizeable, highly retentive metal; and each pair of reeds and cores are of such relative sizes and are so mounted with respect to each other that the gap between the arms of the C aligns with the crossarm of the *t* and areas at the ends of the crossarm of the *t* overlap facing portions of the ends of the core arms, the overlapping areas of the core arms comprising the pole faces of the core.

122. A printer as recited in claim 1:

I. wherein the individual actuators for the print wires are electromagnetic actuators, each of which comprises:

a. a flat, C-shaped magnet core of magnetizable material;

b. a flat, Latin cross, *t*-shaped armature of ferromagnetic material; and c. means for mounting the armature and core with respect to each other and the printing station so that:

1. the core and armature are disposed generally vertically and parallel to each other, 2. the crossarm of the *t* faces and extends across the space between the arms of the C, and areas at the tips of the crossarm overlap areas at the tips of the arms of the C, which latter areas define pole faces of the magnet core, 3. the crossarm is movable toward and away from the pole faces of the core and the print station, and 4. the crossarm is normally spaced a predetermined distance *d* from the pole faces when the core is in a neutral, nonmagnetized state, *d* being set so that, when the core is magnetized, the crossarm is attracted to the pole faces; and d. means for magnetizing and demagnetizing the core; and II. wherein the mounting means for the print wires comprise means for coupling the outer end of each print wire to the tip of the corresponding armature.

123. An electromagnetic actuator comprising:

a. a flat, generally C-shaped magnet core of magnetizable material;

b. a flat, generally *t*-shaped armature of ferromagnetic material; and c. means for mounting the armature with respect to the core so that 1. the core and armature are generally parallel to each other, 2. the crossarm of the *t* faces and extends across the space between the arms of the C, and areas at the tips of the crossarm overlap areas at the tips of the arms of the C, which latter areas define pole faces of the magnet core, 3. the crossarm is movable toward and away from the pole faces of the core, and 4. the crossarm is normally spaced a predetermined distance *d* from the pole faces when the core is in a neutral, nonmagnetized state, *d* being set so that, when the core is magnetized, the crossarm is attracted to the pole faces; and d. means for magnetizing and demagnetizing the core to attract and release the armature.

124. An actuator as recited in claim 123, wherein the core is symmetrical, generally triangular C-shaped plate, in which the arms of the C slope inwardly toward each other from a base leg to define an air gap in the space between the inner tips of the arms.

125. An actuator as recited in claim 124, wherein the base of the *t*-shaped armature is fastened to the center of the base leg of the core, and the armature comprises a spring reed mounted so that the reed is cocked when the core is energized and the spring body propels the crossarm of the reed away from the core when the core is de-energized.

126. An actuator as recited in claim 125, wherein the reed comprises a *t*-shaped member with a tip extending above the crossarm, and a workpiece to be reciprocated by the actuator is coupled to the reed above the armature.

127. Apparatus as recited in claim 126, wherein the core and the means for magnetizing and demagnetizing the core are so constructed and arranged that the core acts as an electromagnet when attracting the reed into engagement with the pole faces of the core, and thereafter acts as a permanent magnet in magnetically latching the reed in the cocked position.

128. Apparatus as recited in claim 127, wherein the means for demagnetizing is arranged to demagnetize the core sufficiently that it can no longer hold the cocked reed, which then fires to propel the workpiece toward a work station, and the means for magnetizing is promptly thereafter reenergized to relatch the reed or rebound in the cocked position.

* * * * *